US011969074B2

(12) United States Patent
Lotti

(10) Patent No.: US 11,969,074 B2
(45) Date of Patent: Apr. 30, 2024

(54) ELECTRIC APPLICATOR AND METHOD FOR RE-AFFIXING ARTIFICIAL LASH EXTENSIONS AND CURLING NATURAL LASHES AND ARTIFICIAL LASH EXTENSIONS ATTACHED TO NATURAL LASHES

(71) Applicant: Lashify, Inc., North Hollywood, CA (US)

(72) Inventor: Sahara Lotti, North Hollywood, CA (US)

(73) Assignee: Lashify, Inc., North Hollywood, CA (US)

( * ) Notice: Subject to any disclaimer, the term of this patent is extended or adjusted under 35 U.S.C. 154(b) by 0 days.

(21) Appl. No.: 17/955,303

(22) Filed: Sep. 28, 2022

(65) Prior Publication Data

US 2023/0105622 A1 Apr. 6, 2023

Related U.S. Application Data

(60) Provisional application No. 63/252,049, filed on Oct. 4, 2021.

(51) Int. Cl.

| | |
|---|---|
| ***A45D 2/48*** | (2006.01) |
| ***A41G 5/02*** | (2006.01) |
| ***A45D 44/00*** | (2006.01) |

(52) U.S. Cl.

CPC ..... *A45D 44/00* (2013.01); *A41G 5/02* (2013.01); *A45D 2/48* (2013.01); *A45D 2200/10* (2013.01)

(58) Field of Classification Search

CPC ..... A45D 2/48; A45D 2200/157; A45D 2200/155; A41G 5/02; A46B 2200/1053; A46B 2200/106

See application file for complete search history.

(56) References Cited

U.S. PATENT DOCUMENTS

| | | | | |
|---|---|---|---|---|
| 2,630,516 A * | 3/1953 | Rausch | ..... | A45D 2/48 219/222 |
| D210,180 S | 2/1968 | Solomon | | |
| D213,239 S | 1/1969 | Flewwellin | | |
| D215,985 S | 11/1969 | Silson | | |

(Continued)

FOREIGN PATENT DOCUMENTS

| | | | |
|---|---|---|---|
| CN | 102355833 | * | 2/2012 |
| CN | 111418982 A | | 7/2020 |

(Continued)

OTHER PUBLICATIONS

Chae et al. translation (Year: 2010).*

(Continued)

*Primary Examiner* — Rachel R Steitz
*Assistant Examiner* — Brianne E Kalach
(74) *Attorney, Agent, or Firm* — Lowenstein Sandler LLP

(57) ABSTRACT

An apparatus includes a handle and a pair of opposing arms coupled to the handle. Each arm includes a first section having a first curvature disposed between a first end portion and a second end portion of the first section. The first curvature shaped to align proximate a lash line of an eye. The apparatus includes a heating unit coupled to the pair of opposing arms and configured to heat the first section of each arm.

26 Claims, 22 Drawing Sheets

(56) References Cited

U.S. PATENT DOCUMENTS

| | | | | |
|---|---|---|---|---|
| 3,478,754 | A * | 11/1969 | Martin, Jr. | A41G 5/02 132/216 |
| 3,516,423 | A | 6/1970 | Seidler | |
| 3,547,135 | A | 12/1970 | Roos | |
| D219,854 | S | 2/1971 | Howard | |
| 3,561,454 | A * | 2/1971 | O'Connell | A41G 5/02 D28/36 |
| D222,518 | S | 10/1971 | Brirtain | |
| D269,820 | S | 7/1983 | Bisson | |
| D483,909 | S | 12/2003 | Todeschini | |
| D485,359 | S | 1/2004 | McMichael | |
| D573,306 | S | 7/2008 | Yoo | |
| D573,308 | S | 7/2008 | Wittke-Kothe | |
| D588,746 | S | 3/2009 | Ross | |
| 7,637,265 | B2 * | 12/2009 | Funatsu | A45D 40/262 132/218 |
| 7,748,391 | B2 | 7/2010 | Vance | |
| D636,127 | S | 4/2011 | Allison | |
| 7,938,128 | B2 * | 5/2011 | Gueret | A45D 40/26 132/218 |
| D783,901 | S | 4/2017 | Kim | |
| D784,615 | S | 4/2017 | Choi | |
| D812,303 | S | 3/2018 | Pascullo | |
| D814,107 | S | 3/2018 | Lotti et al. | |
| D850,715 | S | 6/2019 | Lotti | |
| D862,796 | S | 10/2019 | Jin Kim | |
| D863,679 | S | 10/2019 | Lotti | |
| D867,664 | S | 11/2019 | Lotti | |
| D887,664 | S | 6/2020 | Liao et al. | |
| D890,430 | S | 7/2020 | Lotti | |
| D895,201 | S | 9/2020 | Lotti | |
| D937,482 | S | 11/2021 | Kim | |
| D952,258 | S | 5/2022 | Lotti | |
| D955,635 | S | 6/2022 | Lotti | |
| D961,845 | S | 8/2022 | Wang | |
| 2005/0166939 | A1 * | 8/2005 | Stroud | A45D 40/30 132/216 |
| 2012/0009002 | A1 * | 1/2012 | Lo | A46B 15/003 401/6 |
| 2020/0323324 | A1 * | 10/2020 | Chang | A45D 2/48 |
| 2020/0323325 | A1 | 10/2020 | Kim | |
| 2022/0160094 | A1 | 5/2022 | Lyons | |

FOREIGN PATENT DOCUMENTS

| | | | |
|---|---|---|---|
| GB | 2516622 | * | 2/2015 |
| JP | S4721880 U | | 11/1972 |
| JP | 2011106066 | * | 6/2011 |
| JP | 2016-163699 | * | 9/2016 |
| KR | 201000112249 | * | 10/2010 |
| WO | 2014029935 A1 | | 2/2014 |
| WO | WO 2015190845 | * | 12/2015 |

OTHER PUBLICATIONS

Chung et al. translation (Year: 2015).*
Arditty translation (Year: 2012).*
International Search Report and Written Opinion for International Application No. PCT/US2022/045558, mailed Dec. 20, 2022, 15 Pages.

* cited by examiner

ELECTRIC APPLICATOR AND METHOD FOR RE-AFFIXING ARTIFICIAL LASH EXTENSIONS AND CURLING NATURAL LASHES AND ARTIFICIAL LASH EXTENSIONS ATTACHED TO NATURAL LASHES

RELATED APPLICATION

This application is a claims the benefit of U.S. Provisional No. 63/252,049, filed Oct. 4, 2021, the entire contents of which is incorporated by reference herein.

FIELD OF THE INVENTION

Embodiments of the disclosure relate generally to applicators for natural lashes and artificial lash extensions and, more specifically, to electric applicators for re-affixing artificial lash extensions and curling natural lashes and/or artificial lash extensions attached to natural lashes.

BACKGROUND

False eyelash extensions have conventionally been used to enhance the length, thickness, and fullness of natural eyelashes. Some false eyelashes may be applied directly to an individual's eyelid. False eyelashes can come in strips (and thus may also be referred to as "strip lashes") that can be trimmed to fit the width of the individual's eyelid.

SUMMARY

The following is a simplified summary of the disclosure in order to provide a basic understanding of some aspects of the disclosure. This summary is not an extensive overview of the disclosure. It is intended to neither identify key or critical elements of the disclosure, nor delineate any scope of the particular embodiments of the disclosure or any scope of the claims. Its sole purpose is to present some concepts of the disclosure in a simplified form as a prelude to the more detailed description that is presented later.

An aspect of the disclosure includes an apparatus comprising a handle; a pair of opposing arms coupled to the handle, each arm comprising a first section having a first curvature disposed between a first end portion and a second end portion of the first section, the first curvature shaped to align proximate a lash line of an eye; and a heating unit coupled to the pair of opposing arms and configured to heat the first section of each arm.

In some embodiments, the apparatus further comprising: a cooling unit configured to cool the first section of each arm.

In some embodiments, each arm further comprises: a first side opposite a second side, and an interior surface opposite an exterior surface, wherein the interior surface and the exterior surface extend between the first side and the second side.

In some embodiments, the first section of each arm comprises a second curvature disposed between the first end portion and the second end portion and along at least a part of the first side corresponding to the first section, and wherein the second curvature is positioned opposite the first curvature.

In some embodiments, the first curvature is disposed along at least a part of the second side corresponding to the first section, and wherein the first curvature is a concave curvature and the second curvature is a convex curvature.

In some embodiments, at least part of the interior surface corresponding to the first section comprises a surface that is substantially flat.

In some embodiments, the at least part of the interior surfaces corresponding to the first sections of the opposing arms are designed to apply pressure to natural lashes and one or more artificial lash extensions arranged at an underside of the natural lashes.

In some embodiments at least part of the exterior surface corresponding to the first section comprises a curved portion with a surface having a third curvature positioned between the first side and the second side.

In some embodiments, the third curvature of the curved portion of the first section is designed to curl one or more of natural lashes or one or more artificial lash extensions arranged at an underside of the natural lashes.

In some embodiments, each arm further comprises a second section positioned between the first section and the handle, wherein the second section of each arm is configured to be pressed towards one another to transition the first section from an open position to a closed position.

In some embodiments, at least an exterior surface of the second section comprises a thermally insulating material.

In some embodiments, the heating unit further comprises: a heating member that extends within the first section of each arm, the heating member to conduct thermal energy to the first section of each arm.

In some embodiments the heating member comprises resistor wire.

In some embodiments, the cooling unit further comprises: a cooling member that extends within the first section of each arm.

In some embodiments, the cooling member of the cooling unit and a heating member of the heating unit are a same member.

In some embodiments, the heating unit comprises a thermoelectric component.

In some embodiments, the heating unit and the cooling unit comprise a same thermoelectric component.

In some embodiments, an exterior surface of the first section comprises a non-stick material.

In some embodiments, the non-stick material comprises silicone.

In some embodiments, the apparatus is configured to transition from an open position to a closed position responsive to an application of pressure to the pair of opposing arms, wherein in the open position the pair of opposing arms are separated from one another.

In some embodiments, the open position of the apparatus is a default position.

In some embodiments, wherein in the closed position an interior surface corresponding to the first section of one of the pair of opposing arms is configured to contact an opposing interior surface of another of the pair of opposing arms.

In some embodiments, wherein at least a part of the first section is joined with the second section, and wherein the joined part is closer to the second end portion than the first end portion of the first section.

In some embodiments, wherein the first section, the second section, and the handle longitudinally extend toward a proximal end.

In some embodiments, wherein an apex of the concave curvature is oriented distally from the second end portion and oriented proximally from the first end portion such that the concave curvature is facing opposite a first side corresponding to the first section.

In some embodiments, wherein the first end portion of the first section of each arm comprises a distal end.

In some embodiments, wherein the distal end of each arm is a single terminal distal end.

In some embodiments, wherein the first curvature of the first section is designed to align substantially flush with a shape of a lash line.

An aspect of the disclosure includes a method comprising: obtaining an electric applicator comprising a pair of opposing arms and a heating unit, each arm comprising a first section having a first curvature disposed between a first end portion and a second end portion of the first section; activating the heating unit of the electric applicator to heat the first sections of each arm; positioning the heated electric applicator in an aligned orientation at an eye area of a user, wherein in the aligned orientation the first curvature of each arm is positioned to align with a lash line of natural lashes; and transitioning the heated electric applicator to a closed position by closing the first sections of the pair of opposing arms on the natural lashes and artificial lash extensions attached to the natural lashes.

In some embodiments, the method further comprises: maintaining the heated electric applicator in the closed position for a first time period to soften an adhesive used to attach the artificial lash extensions to the natural lashes.

In some embodiments, the method, further comprises: rotating the heated electric applicator in the closed position along a rotational axis to transition the heated electric applicator from the aligned orientation to a rotated orientation, wherein in the rotated orientation at least part of the natural lashes and at least part of the artificial lash extensions contact an exterior surface of the first section of at least one of the pair of opposing arms of the heated electric applicator; and maintaining the heated electric applicator in the closed position and the rotated orientation for a second time period to curl one or more of the natural lashes or the artificial lash extensions.

In some embodiments, the method, further comprises: removing the heated electric applicator from the eye area; activating a cooling unit of the electric applicator to cool the first sections of each arm; positioning the cooled electric applicator in the aligned orientation at the eye area of the user; transitioning the cooled electric applicator to the closed position; and maintaining the cooled electric applicator in the closed position for a third time period to harden the adhesive used to attach the artificial lash extensions to the natural lashes.

In some embodiments, the method, further comprises: applying adhesive to the natural lashes of the user; arranging the artificial lash extensions at the natural lashes; and affixing the arranged artificial lash extensions to the natural lashes using the adhesive.

In some embodiments, wherein the applying, the arranging and the affixing are performed during a first application session, and wherein the activating, the positioning and the transitioning are performed during a second application session.

In some embodiments, wherein the artificial lash extensions are attached at an underside of the natural lashes.

In some embodiments, wherein each arm further comprises a first side opposite a second side, and an interior surface opposite an exterior surface, wherein the interior surface and the exterior surface extend between the first side and the second side.

In some embodiments, wherein the first section of each arm comprises a second curvature disposed between the first end portion and the second end portion and along at least a part of the first side corresponding to the first section, and wherein the second curvature is positioned opposite the first curvature.

In some embodiments, wherein the first curvature is disposed along at least a part of the second side corresponding to the first section, and wherein the first curvature is a concave curvature and the second curvature is a convex curvature.

In some embodiments, wherein at least part of the interior surface corresponding to the first section comprises a surface that is substantially flat.

In some embodiments, wherein the at least part of the interior surfaces corresponding to the first sections of the opposing arms are designed to apply pressure to natural lashes and the artificial lash extensions attached to the natural lashes.

In some embodiments, wherein at least part of the exterior surface corresponding to the first section comprises a surface having a third curvature positioned between the first side and the second side.

In some embodiments, wherein the at least part of the exterior surface corresponding to the first section is designed to curl one or more of the natural lashes or the artificial lash extensions attached to the natural lashes.

BRIEF DESCRIPTION OF THE DRAWINGS

The disclosure is illustrated by way of example, and not by way of limitation, in the figures of the accompanying drawings in which like references indicate similar elements. It should be noted that different references to "an" or "one" embodiment in this disclosure can be, but are not necessarily to the same embodiment, and such references mean at least one.

Figure 1:
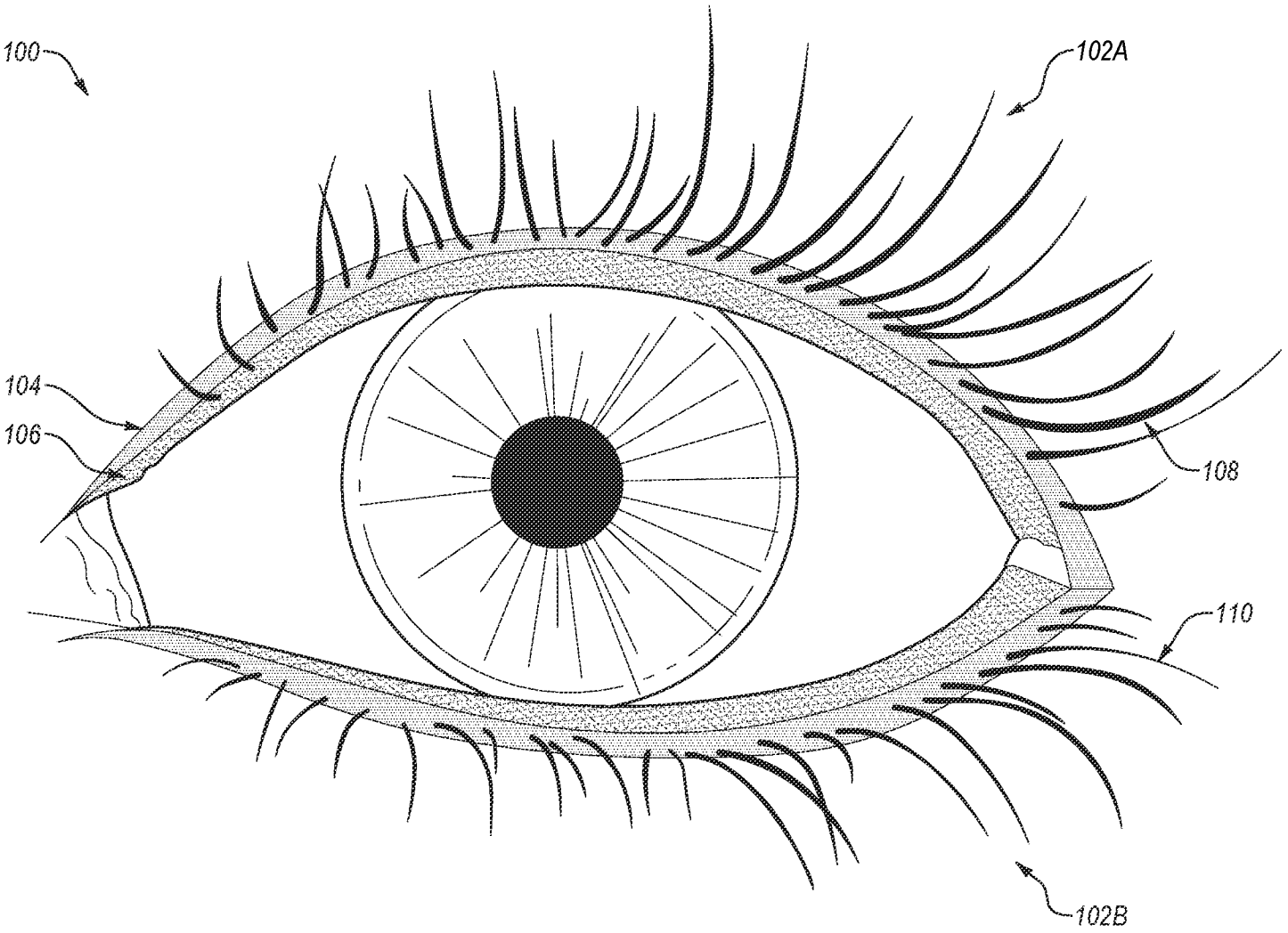
FIG. 1 is an illustration of an eye area, in accordance with some embodiments of the disclosure.

The figures depict various embodiments for the purpose of illustration only. Those skilled in the art will readily recognize that alternative embodiments may be employed without departing from the principles as disclosed herein.

DETAILED DESCRIPTION

As noted above, eyelash extensions have been used to enhance the length, thickness, and fullness of natural eyelashes. Strip lashes applied to a user's eyelids are easily distinguishable from a user's natural lashes and can be unconformable if worn for long periods of time. Some eyelash extensions are applied to an individual's natural lashes hair by hair or in some cases cluster by cluster. Due to the precise nature of applying single hairs or clusters, skilled technicians can perform the application of said single hairs or clusters. Such services can cost hundreds of dollars and take up to several hours to complete.

In some cases, an individual may desire to curl the individual's natural lashes and/or the eyelash extensions that have been applied to the individual's natural lashes. Due to the unique geometry and sensitivity of the eye area, existing tools may not use heat to curl the natural lashes and/or artificial lash extensions or have a shape or other features that are ill-suited to curl the natural lashes and/or eyelash extensions.

In still other cases, the eyelash extensions that are worn by an individual may fall off or otherwise have reduced bond to the individual's natural lashes. The individual may desire to improve the bond quality and increase the amount of time the eyelash extensions can be worn by the individual.

To address the above-mentioned and other challenges an electric applicator is disclosed herein that is designed to curl one or more of the natural lashes or artificial lash extensions attached to the natural lashes. The electric applicator provides a new and improved way of curling the lashes, artificial lash extensions, or both with much more control than conventional solutions. The electric applicator can also be used to re-affix artificial lash extensions that have been previously attached to the natural lashes (e.g., days before) so that the bond between the natural lashes and artificial lash extension is improved and extended over time.

In some embodiments, the electric applicator includes a handle and a pair of opposing arms coupled to the handle. Each arm includes a section that has a first curvature between a first end portion and a second end portion of the section. The first curvature is shaped to align proximate the lash line of the eye area. The electric applicator includes a heating unit that is configured to heat the section of each arm (e.g., both the interior surface and exterior surface of the section).

In some embodiments, the electric applicator includes a cooling unit to cool the section of each arm.

In some embodiments, at least part of the interior surface corresponding to the first section of each arm includes a surface that is substantially flat and designed to apply pressure to the natural lashes and one or more artificial lash extensions attached to (e.g., an underside of) the natural lashes. In some embodiments, at least part of the exterior surface corresponding to the first section includes a curved portion with a surface having a curvature positioned between the first side and the second side of each arm. The curvature of the curved portion of the first section (along with heat) is designed to curl one or more of natural lashes or one or more artificial lash extensions attached to the natural lashes.

In an illustrative embodiment to curl the natural lashes and artificial lash extensions, the electric applicator can be heated to a desired temperature. The heated electric applicator can be closed on the natural lashes and artificial lash extensions attached thereon such that the heated interior surfaces of the arms of the heated electric applicator contact and apply pressure to the natural lashes and artificial lash extensions therebetween. The heated electric applicator can be rotated about a rotational axis and the natural lashes and/or artificial lash extensions can contact the heated exterior surface (that can also be curved) of the section of at least one arm. Contact between the natural lashes and/or artificial lash extensions and the interior surfaces and exterior surface(s) of the arm(s) of the heated electric applicator can be maintained for a time period to set the curl of the natural lashes and/or artificial lash extensions.

In another illustrative embodiment to re-affix artificial lash extensions attached to that natural lashes using an adhesive, the electric applicator can be heated to a desired temperature. The original attachment of the artificial lash extensions may have occurred at some time period prior, such as days prior to the re-affixing. The heated electric applicator can be closed on the natural lashes and artificial lash extensions attached thereon such that the heated interior surfaces of the arms of the heated electric applicator contact and apply pressure to the natural lashes and artificial lash extensions therebetween. The originally applied adhesive can begin to soften and be redistributed among the natural lashes and the adjacent artificial lash extensions. After a time period, the heated electric applicator can be removed and the cooling unit of the electric applicator activated. The pair of opposing arms can cool to a desired temperature and be closed on the natural lashes, artificial lash extensions, and redistributed adhesive. The redistributive adhesive can harden and recreate and improve the bond between the natural lashes and artificial lash extensions such that the time period during which the artificial lash extensions can be worn is extended.

FIG. 1 is an illustration of an eye area, in accordance with some embodiments of the disclosure. As shown in FIG. 1, the eye area 100, such as a human eye area, can include upper natural lashes 102A (also referred to as "natural lashes 102A," "natural eyelashes 102A," or "natural lash 102A" herein) and lower natural lashes 102B (also referred to as "natural lashes 102B," "natural eyelashes 102B," or "natural lash 102B" herein). Natural lashes 102A and 102B can have an underside and topside opposite the underside. For example, natural lashes 102A illustrate an underside 108. Natural lashes 102B illustrate a topside 110. Natural lashes 102A and 102B are collectively referred to as natural lashes 102, herein.

The eye area 100 includes an upper lash line 104 (also referred to as "lash line 104" herein) and upper waterline 106 (also referred to as "waterline 106" herein). In some embodiments, a lash line, such as the upper lash line 104 or lower lash line of natural lashes 102B, can include the area between the natural lashes. In some embodiments, the lash line can be curved and follow the alignment of the natural lashes 102. In some embodiments, the upper lash line 104 can include some area of the skin that is above (e.g., directly above) the natural lashes 102A and/or below (e.g., directly below) the natural lashes 102A. Similarly, the lower lash line can include some area of the skin that is below (e.g., directly below) the natural lashes 102B and/or above (e.g., directly above) the natural lashes 102B.

In some embodiments, the waterline (also referred to as "wetline" herein), such as upper water line 106 corresponding to natural lashes 102A and lower water line corresponding to natural lashes 102B, can include an area (or line) of skin that is exposed between the natural lashes 102 and the eye.

Spatially relative terms, such as "under," "upper," "lower," "top," "bottom," and so forth as used herein refer to a relative position of one element with respect to another element. Unless otherwise specified, the spatially relative terms are not intended to be limiting to the absolute orientation, and are intended to encompass different orientations (e.g., rotated 90 degrees, flipped, etc.) of elements in addition to the orientation depicted in the Figures. For example, if elements in the Figures are rotated 180 degrees, elements described as "upper" elements can then be considered oriented as "lower" elements, without deviating from aspects of the disclosure.

Figure 2:
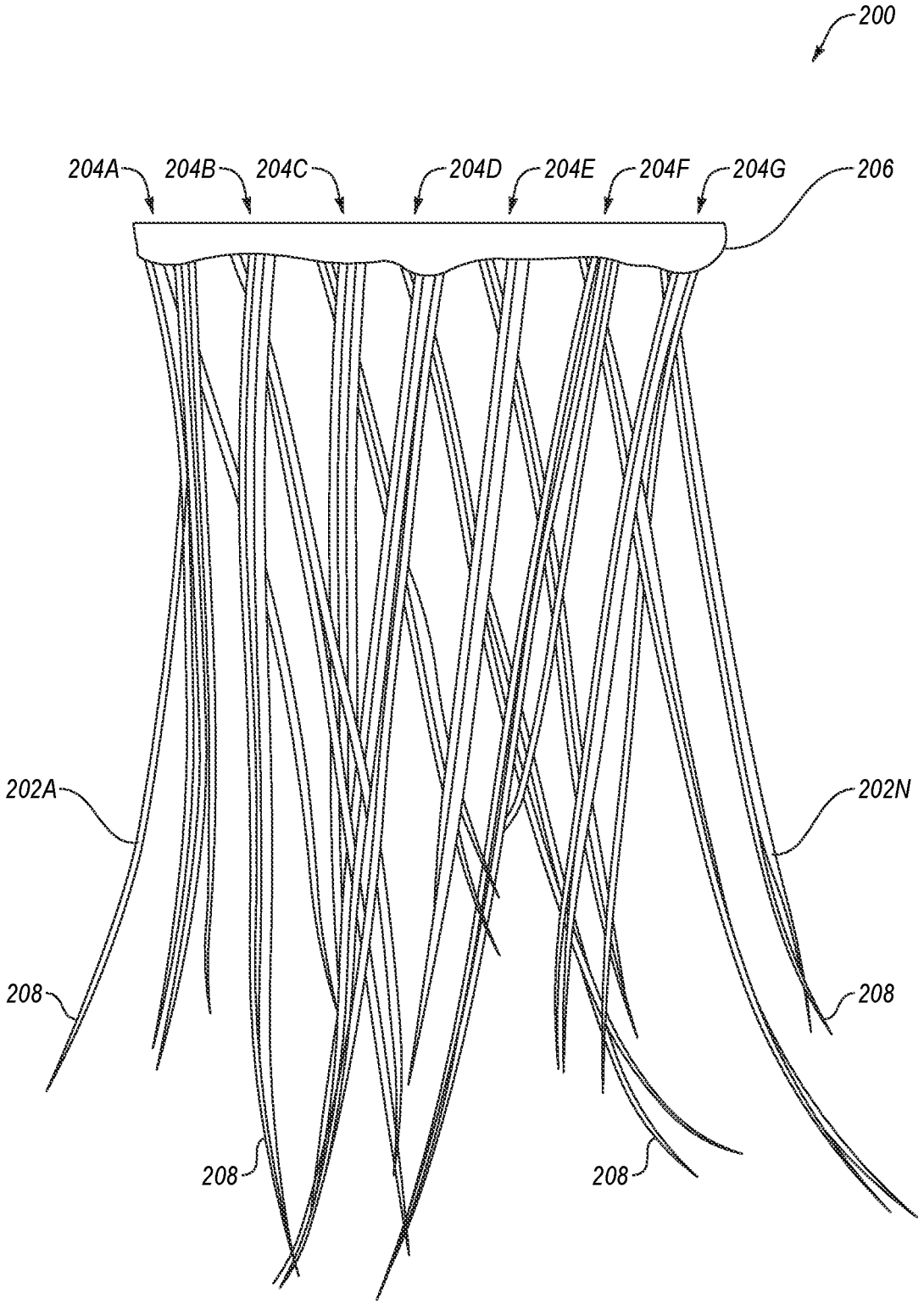
FIG. 2 is an illustration of an exemplary artificial lash extension, in accordance with some embodiments of the disclosure.
Figure 3:
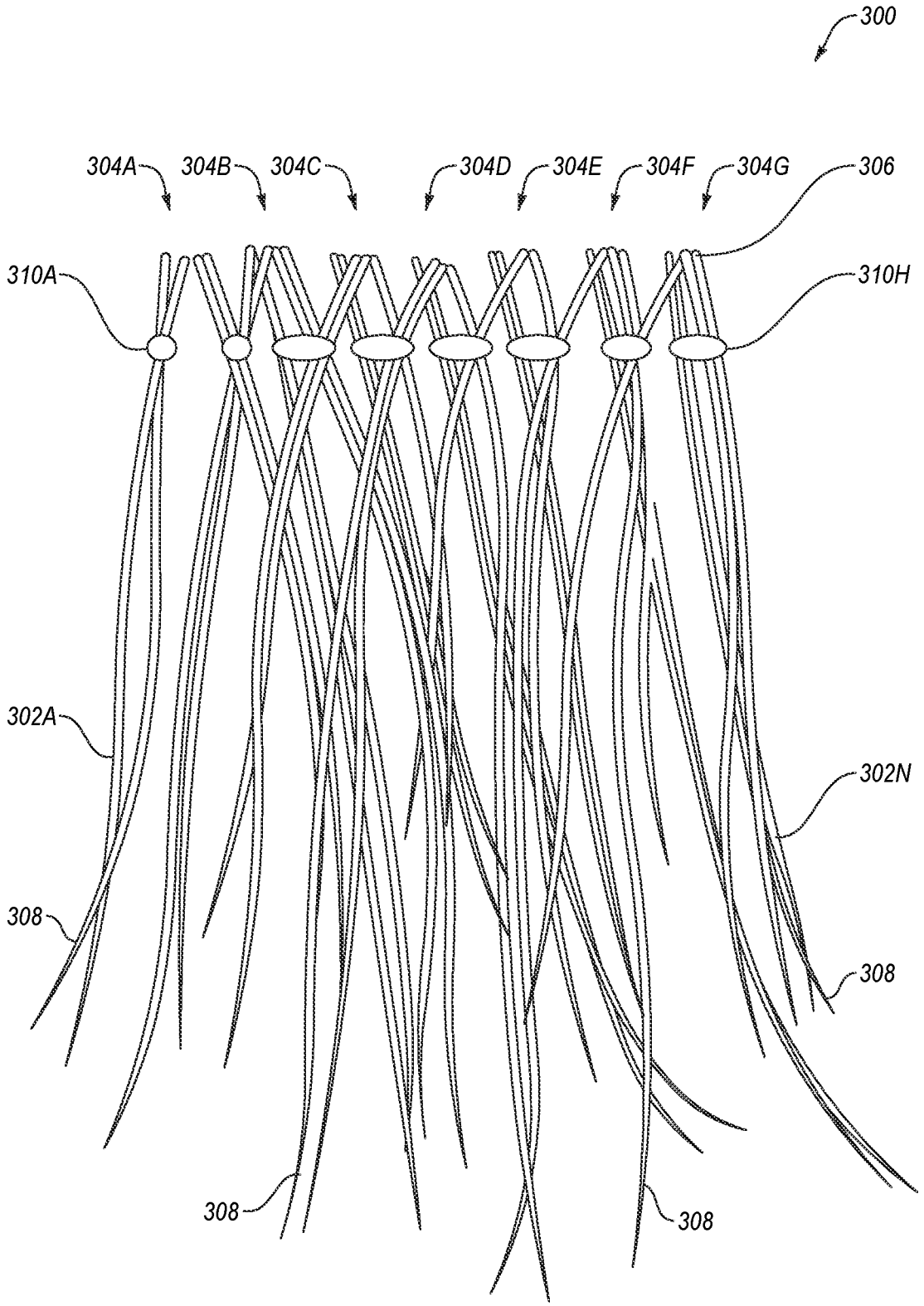
FIG. 3 is an illustration of another exemplary artificial lash extension, in accordance with some embodiments of the disclosure.

FIG. 2 is an illustration of an exemplary artificial lash extension, in accordance with some embodiments of the disclosure. FIG. 3 is an illustration of another exemplary artificial lash extension, in accordance with some embodiments of the disclosure.

In some embodiments, one or more of artificial lash extension 200 or artificial lash extension 300 (both also referred to as "lash extension" or "artificial eyelash extension" herein) are designed or configured for application at the natural lashes, such as at the underside of the natural lashes of a user or even the topside of the natural lashes of a user. In some embodiments, one or more of artificial lash extension 200 or artificial lash extension 300 can be part of a set of multiple artificial lash extensions. In some embodiments, one or more of artificial lash extension 200 or artificial lash extension 300 can be a segment of a "full" artificial lash extension such that, for instance, when multiple artificial lash extensions are arranged adjacent to one another at the underside of natural lashes (e.g., natural lashes 102A) the arranged artificial lash extensions span the length of the natural lashes. In some embodiments, the artificial lash extensions (e.g., segments) can be shorter than the horizontal length of the natural lashes (e.g., length of the lash line). In other embodiments, an artificial lash extension can be longer such that the artificial lash extension is a "full" artificial lash extension that substantially spans the horizontal length of the natural lashes. The artificial lash extensions can be arranged to substantially align with the lash line of the user. In some embodiments, using artificial lash extensions that are independent segments can allow an individual artificial lash extension to move independently when bonded to the underside of natural lashes, which mimics the movement of the natural lashes and can improve the feel, comfort, and longevity of the artificial lash extensions.

Artificial lash extension 200 and artificial lash extension 300 respectively depict artificial hairs 202A-202N (collectively referred to as "artificial hairs 202" herein) and artificial hairs 302A-302N (collectively referred to as "artificial hairs 302" herein). In some embodiments, the artificial hairs of an artificial lash extension, such as artificial lash extension 200 or artificial lash extension 300, can be formed from one or more synthetic materials, including but not limited to polybutylene terephthalate (PBT), acrylic resin, polyester (e.g., polyethylene terephthalate (PET)), other polymers, other synthetic material, or a combination thereof. In alternative embodiments, a natural material such as natural hair (e.g., human hair or mink hair) can be used. In some embodiments, the artificial hairs of a particular artificial lash extension can have one or more lengths and/or one or more diameters. In some embodiments, the diameter of an artificial hair can be between approximately 0.0075 millimeters (mm) (e.g., 0.0075 mm+/−0.0025 mm) to 0.3 mm (e.g., 0.3 mm+/−0.05 mm). In some embodiments, the ends of one or more of the artificial hairs can be tapered. In some embodiments, the one or more of the artificial hairs can be curled or shaped in particular direction. For example, the ends 208 of artificial hairs 202 or the ends 308 of artificial hairs 302 can be tapered or curled or both. In some embodiments, the artificial hairs can range from 3 mm to 30 mm in length or in some instances even longer.

In some embodiments, an artificial lash extension can include a base. For example, artificial lash extension 200 includes base 206. In some embodiments, artificial lash extension 300 may or may not (as illustrated) include a base similar to base 206 of artificial lash extension 200. The base can include a top side (e.g., facing out of the page and towards the reader), a bottom side, a back side, a front side, and two lateral sides. In some embodiments, one or more of the multiple artificial hairs of an artificial lash extension protrude out the front side of the base. When arranged at the underside of natural lashes, the backside of the artificial lash extension can point towards the user's eye. The thickness (e.g., between the topside and bottom side of the base) can be between approximately 0.05 millimeters (mm) and approximately 0.15 mm (e.g., 0.05 mm+/−0.01 mm). In some embodiments, the thickness of the base can be less than 0.05 mm. In some embodiments, the low profile of the base is designed to allow the artificial lash extension to be light weight so as to better adhere to the underside of the natural lashes and in some instances to prevent obstruction of a user's view. The low profile of the base can at least in part be attributed to an application of heat in the formation of the base.

In some embodiments, one or more of the top side or bottom side (e.g., surface) of the base is substantially flat (e.g., having a flatness control tolerance value of +/−0.03 mm or +/−0.015 mm). In some embodiments, the flatness of the base of the artificial lash extension 200 is designed to allow improved contact and adhesion to a surface, such as the underside of natural lashes or the opposing surface of another artificial lash extension. The flatness of the base can at least in part be attributed to an application of heat in the formation of the base.

In some embodiments, the base can be formed at least in part by an application of heat at or near the area of the base. The application of heat can cause one or more of the artificial hairs (e.g. all of the artificial hairs or clusters) of an artificial lash extension to be connected to or at the base. In some embodiments, a heated fixture, such as a heated platen, a heated crimp, heating lamp, heating oven, or other device can be used (e.g., pressed against the artificial hairs) to cause the artificial hairs (e.g., artificial hairs of one or more clusters) to at least become soft, tacky or sticky (e.g., at least partially melt). In some embodiments, the at least partially melted artificial hairs (e.g., of one or more clusters) form at least part of the base. In some embodiments, the application of heat at least partially melts the artificial hairs such that the multiple artificial hairs connect to or at the base of the artificial lash extension. In some embodiments, the application of heat at least partially melts the artificial hairs such that at least some of the multiple artificial hairs connect to each other at the base of the artificial lash extension.

In some embodiments, to at least partially melt the artificial hairs (e.g. and/or artificial hairs of a cluster) at the base the artificial hairs can be heated to a temperature between 55-100 degrees Celsius, which can cause the artificial hairs to be connected to or at the base and/or in some cases to each other. In some embodiments, the application of heat is at a temperature above, within or at the glass transition temperature of the material of the artificial hairs. At the glass transition temperature the material of the artificial hairs transitions from brittle to a softer, rubbery, tacky or pliable state. In some embodiments, the application of heat is at a temperature above, within or at the melt temperature of the material of the artificial hairs. For example, the base area (and/or other parts of the artificial lash extension) can be heated above 200 degrees Celsius.

In some embodiments, one or more additional artificial materials, such as one or more artificial hairs or other material(s) can be placed substantially orthogonal to the artificial hairs (e.g., generally aligned horizontal with respect to the lengthwise direction of the artificial hairs). In some embodiments, the additional artificial material can be connected to the artificial hairs. In some embodiments, the additional artificial material can be considered a base or at least an initial base. In some embodiments, the additional artificial material can be considered at least part of the base that is to be formed. In some embodiments, heat can be applied to the area where the base is to be formed (which can include the additional artificial material). In some embodiments, one or more of the artificial hairs and/or the additional artificial material can at least partially melt to at least in part, form the base. In some embodiments, the additional artificial material can include an adhesive (e.g. application of adhesive) that is used alone or with one or more other artificial material(s) (e.g., horizontal artificial hair, nylon, etc.). In some embodiments, the application of heat can be used to help cure the applied adhesive. In some embodiments that use an adhesive, the application of heat may or may not partially melt the artificial hairs.

In some embodiments, the base can at least in part be formed by an application of pressure. In some embodiments, the base can be formed by an application of pressure combined with an application of heat. For example, an application of pressure along with an application heat can be concurrently applied at the base of the artificial lash extension to cause at least some of the artificial hairs (e.g., some of the artificial hairs of a cluster) to at least partially melt and connect together (e.g., secured together) and/or connect to (e.g., secured to) an additional artificial material.

In some embodiments, prior to the application of heat the artificial hairs may be tied (e.g., knotted) to a support or base thread or fiber to align the artificial hairs and prevent the horizontal spreading of the artificial hairs. Heat can be applied as described above (while the artificial hairs are knotted to a support thread) such that the support thread forms part of the base. In other instances, heat can be applied below the horizontal support thread. For instance, the support thread can hold the artificial hairs in place and the application of heat can form a base below the support thread. In other embodiments, the artificial hairs are not aligned with a support thread (e.g., are not knotted on a support thread) before or during the formation of the base using the application of heat.

In other embodiments, the artificial hairs can be arranged using a stencil or other arrangement device before and/or during the formation of the base using the application of heat. In some embodiments, one or more applications of heat can be performed to form the base. In an alternative embodiment, the base can be formed in part or in full using a chemical process.

In some embodiments, one or more of artificial lash extension 200 and artificial lash extension 300 include artificial hairs 202 and 302 that are respectively configured into clusters of artificial hairs 204A-204G (collectively referred to as "clusters 204" herein) and clusters of artificial hairs 304A-304G (collectively referred to as "clusters 304" herein). In some embodiments, a cluster of artificial hairs can refer to two or more artificial hairs that are grouped together. In some embodiments, two or more artificial hairs of a cluster can contact one another before and/or after an application of heat. In some embodiments, 2-30 artificial hairs can be included in a cluster.

In some embodiments, the clusters of artificial hairs can be connected to or at the base with an application of heat in a similar manner as described above. In some embodiments, the application of heat can at least partially melt at least some of the artificial hairs in one or more clusters of the artificial lash extension. In some embodiments, the application of heat can at least partially melt at least some of the artificial hairs of at least one cluster so that at least some of the artificial hairs of the cluster connect to one other. In some embodiments, the application of heat can at least partially melt at least some of the artificial hairs of at least one cluster so that at least some of the artificial hairs of the cluster connect to the base of the artificial lash extension (and/or form, at least in part, the base of the artificial lash extension). In some embodiments, at least some of the artificial hairs of at least one clusters are connected to one another at a respective part of the base by at least the application of heat.

In some embodiments, the clusters are connected to one another at the base by the application of heat. In some embodiments, one or more of the clusters of the artificial lash extension are directly connected to at least one adjacent cluster at the base. In some embodiments, one or more of the clusters of the artificial lash extension are indirectly connected to at least one adjacent cluster of the artificial lash extension at the base.

In some embodiments, at least two artificial hairs of an artificial lash extension crisscross each other. For example, two artificial hairs of a particular cluster can crisscross one another. In some embodiments, one or more individual clusters of artificial hairs can be formed using an application of heat as described above. Thus, the clusters can have a base (e.g., cluster base). The clusters can be arranged and heat can be applied, as described above, to the cluster bases to form at least in part the base (e.g., base 206) of the artificial lash extension.

In some embodiments, artificial lash extensions 200 or 300 may be 4-10 mm wide. In some embodiments, artificial lash extension 200 or 300 may be 5-6 mm wide. In some embodiments, the width of an artificial lash extension is much wider than a single cluster that is typically 1-2 mm wide.

Artificial lash extension 300 further illustrates adjacent artificial hairs (or adjacent clusters 304) that are coupled or secured to one another at connecting portions 310A-310H (collectively referred to as "connecting portions 310" herein) of the crisscrossing artificial hairs 302. For example, at least one hair of particular cluster can be secured (e.g., directly or indirectly) to one or more hairs of an adjacent cluster at a connecting portion. In some embodiments, connecting portions can connect artificial hairs (e.g., clusters) of an artificial lash extension together at areas between the two ends of the artificial hairs such that the artificial hairs of the of the artificial lash extension are connected directly or indirectly to one another to form an artificial lash extension and both ends of the artificial hairs not connected together (e.g., open ended).

In some embodiments, the connecting portions 310 can be considered a base, as described herein. In some embodiments, the connecting portions can be formed by an application of heat in a similar manner as described herein. In some embodiments, the connecting portions can be formed by an application of pressure in a similar manner as described herein. In some embodiments, the connecting portions 310 can be formed using one or more of an application of heat, an application of adhesive, an application of pressure, or a chemical process as described herein. For example, the crisscrossing artificial hairs 302 are connected or secured together approximately 1 mm to approximately 5 mm (+/−0.5 mm) above the ends 306 of the artificial hairs 302 (e.g. the ends 306 that are opposite the ends 308).

In some embodiments, the clusters can be secured to one another above ends 306 using an artificial material to form connecting portions 310. In some embodiments, additional artificial material such as one or more artificial hairs or other material(s) can be placed or connected horizontally with respect to the lengthwise direction of the artificial hairs (e.g., across the area designated by the connecting portions 310). The artificial hairs or clusters of artificial hairs can be connected to the additional artificial material using one or more of an application of heat, an application of adhesive, an application of pressure or a chemical process as described herein. In some embodiments, the application of the additional artificial material that is used to connect the artificial hairs of artificial lash extension 300 can be similar to the application of additional artificial material used to form a base as described herein.

In some embodiments, the base (similar to base 206 of artificial lash extension 200) can be formed and subsequently removed after the formation of the connecting portions 310, such that the artificial lash extension 300 does not include the base. In some embodiments, the secured connecting portions 310 can hold artificial hairs 302 of the artificial lash extension 300 together in the absence of a base. In some embodiments, the connecting portions 310 of the crisscrossing artificial hairs 302 can be formed without forming a base that similar to base 206 of artificial lash extension 200.

In some embodiments, an artificial lash extension, such as artificial lash extension 200 or artificial lash extension 300, can be designed to be separable such that one or more artificial hairs and/or clusters can be detached from the artificial lash extension. In some embodiments, the one or more artificial hairs and/or clusters can be detached from the artificial lash extension using an applicator, as described herein. In some embodiments, the base and/or connecting portions can be brittle such that artificial hairs and/or clusters can be detached from the artificial lash extension by bending the base or connecting portions artificial lash extension less than 45 degrees from resting position (e.g., flat base). For example, the artificial hairs and/or clusters of an artificial lash extension can be designed such that the connection between the artificial hairs and/or clusters can be broken with minimal force.

It should be appreciated that artificial lash extension 200 and 300 are provided for purposes of illustration, rather than limitation. In some embodiments, artificial lash extension 200 and/or artificial lash extension 300 can be used with an applicator, as described herein. In some embodiments, artificial lash extensions different from artificial lash extension 200 and 300 can be used with applicator, as described herein.

Figure 4A:
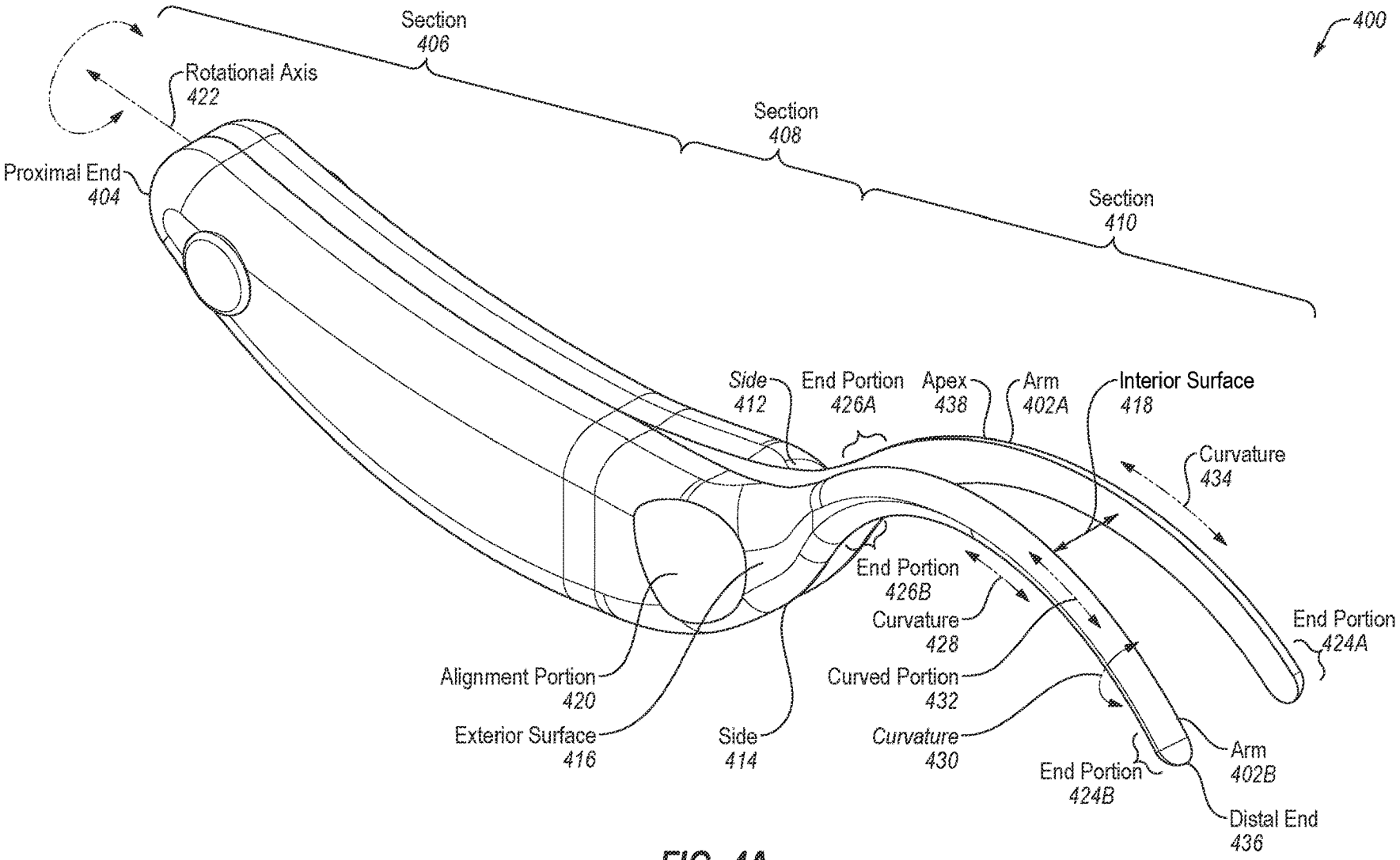
FIG. 4A is an illustration of an electric applicator, in accordance with some embodiments of the disclosure.

FIG. 4A is an illustration of an electric applicator, in accordance with some embodiments of the disclosure. Electric applicator 400 is designed to at least apply heat to one or more of natural lashes or one or more artificial lash extensions attached to the natural lashes. In some embodiments, the heated electric applicator 400 (e.g., heated mode) can be used to curl one or more of the natural lashes or the one or more artificial lash extensions attached to the natural lashes. In some embodiments, the heated electric applicator 400 can used to soften an adhesive, such as an existing adhesive, that attaches the one or more artificial lash extensions to the natural lashes. In some embodiments, the softened adhesive can be redistributed to areas where the artificial lash extensions contact the natural lashes to help improve the bond between the natural lashes and one or more artificial lash extensions.

In some embodiments, electric applicator 400 is designed to at least cool one or more of the natural lashes, one or more artificial lash extensions attached to the natural lashes, or the adhesive attaching the artificial lash extension to the natural lashes. In some embodiments, the cooled electric applicator 400 (e.g., cooled mode) can be used to harden the adhesive that has been previously soften and redistributed among the artificial lash extensions and natural lashes using the heated electric applicator 400.

In some embodiments, electric applicator 400 can include multiple sections, such as section 406, section(s) 408, and section(s) 410. In some embodiments, section 406 (also referred to as "handle" herein) includes a proximal end 404 of the electric applicator 400. In some embodiments, section 406 can house at least some of the electric elements of the electric applicator 400. In some embodiments, section 406 can be designed to allow a user to hold or grip the electric applicator 400.

In some embodiments, electric applicator 400 includes a pair of opposing arms such as arm 402A and arm 402B (generally referred to as "arm(s) 402" herein). In some embodiments, each arm 402 can include multiple sections, such section 408 and section 410. In some embodiments, arms 402 can be joined to or at section 406. In some embodiments, section 408 of electric applicator 400 can be used by an individual to close the arms 402 of the electric applicator 400. In some embodiments, section 410 can be heated or cooled and used to manipulate one or more of natural lashes, one or more artificial lash extensions attached to the natural lashes, or adhesive the connects the natural lashes to the one or more artificial lash extensions, as described herein. In some embodiments, electric applicator 400 and in particular each arm 402, includes side 412 (e.g., top side) and side 414 (e.g., bottom side), an exterior surface 416, and an interior surface 418. In some embodiments, for each arm 402 side 412 is opposite side 414 and the interior surface 418 is opposite exterior surface 416. In some embodiments, the interior surface 418 and the exterior surface 416 of each arm 402 extend between side 412 and side 414.

In some embodiments, section 408 of each arm 402 is positioned between section 410 and section 406 of the corresponding arm 402. In some embodiments, section 408 of each arm 402 can be positioned and connected to the section 406 at one end and to section 410 at the opposite end. In some embodiments, section 408 of each arm 402 is configured to be pressed towards one another to transition section 410 from an open position to a closed position, as further described below.

In some embodiments, at least the exterior surface 416 of section 408 can include a thermally insulating material. The thermally insulating material can be designed to help protect a user's hand from the thermal energy (e.g., heat or cooling) produced or extracted by the electric applicator 400. In some embodiments, section 408 of each arm 402 can include a textured portion on at least part of the exterior surface 416 corresponding to section 408. In some embodiments, the textured portion can be designed to enhance the grip of electric applicator 400. In some embodiments, the textured portion can include parallel grooves and/or ridges. In other embodiments, the textured portion can include any type of texture. In some embodiments, section 408 does not include a textured portion and is non-textured.

In some embodiments, section 408 of each arm 402 can include an alignment portion 420 such as an indentation (e.g., circular indentation as illustrated). The alignment portion 420 can be used to help guide the user's fingers to an area of the electric applicator 400 where the user can press the opposing arms 402 together to transition the electric applicator 400 from an open position to a closed position.

In some embodiments, each arm 402 includes a section 410. In some embodiments, section 410 extends distally from section 408. In some embodiments, section 410 of each arm 402 includes two end portions. For example, section 410 of arm 402A includes end portion 424A and end portion 426A. Section 410 of arm 402B includes end portion 424B and end portion 426B. End portion 424A and end portion 424B are generally referred to as end portion(s) 424 herein. End portion 426A and end portion 426B are generally referred to as end portion(s) 426 herein.

In some embodiments, section 410 of each arm includes a curvature 428 disposed between the end portion 424 and end portion 426. In some embodiments, the curvature 428 of each arm 402 is disposed along the side 414 of the arm 402 corresponding to section 410. In some embodiments, the curvature 428 is a concave curvature. In some embodiments, the apex 438 of curvature 428 and/or curvature 434 of section 410 of each arm 402 is orientated distally from end portion 426 and proximally from end portion 424 such that curvature 428 is facing opposite side 412 of section 410. In some embodiments, curvature 428 of section 410 of each arm 402 is designed to align proximate a lash line of an eye (e.g., substantially flush with a shape of a lash line of a user's eye).

In some embodiments, section 410 of each arm 402 includes a curvature 434. In some embodiments, curvature 434 of section 410 of each arm 402 is disposed between end portion 424 and end portion 426. In some embodiments, curvature 434 is disposed along at least part of the side 412 of section 410. In some embodiments, curvature 428 is opposite curvature 434. In some embodiments, curvature 434 includes a convex curvature.

In some embodiments, the end portion 424 of section 410 of each arm 402 includes a distal end 436 of the respective arm 402 (e.g., the tip of the arm or tips of the electric applicator 400). In some embodiments, the distal end 436 of each arm 402 is a single terminal distal end of the respective arm 402.

In some embodiments, for each arm 402 at least part of section 410 is joined with section 408. The joined part is closer to end portion 426 than to end portion 424 of section 410. In some embodiments, section 406, section 408, and section 410 longitudinally extend towards the proximal end 404.

In some embodiments, for each arm 402 at least part of the interior surface 418 corresponding to section 410 includes a surface that is substantially flat (e.g., having a flatness control tolerance value of +/−0.5 mm or +/−0.015 mm) (also referred to as substantially planar or flat). In some embodiments, the interior surface 418 that extends between end portion 424 and end portion 426 of section 410 is all or majority (e.g., greater than 50 percent) substantially flat. In some embodiments, the at least part of the interior surfaces 418 corresponding to sections 410 of the opposing arms 402 are designed to apply pressure to one or more of natural lashes or one or more artificial lash extensions arranged at the natural lashes (e.g., at the underside of the natural lashes). For example, the flat interior surfaces of section 410 are configured to come together and contact one another in a closed position. In some embodiments, the flat interior surface 418 extends from the apex 438 of section 410 towards end portion 424 and towards end portion 426 of each arm 402.

In some embodiments, for one or more of arms 402 at least part of the exterior surface 416 corresponding to section 410 includes a curved portion having a surface with a curvature 430 positioned between side 412 and side 414. In some embodiments, curvature 430 extends between side 412 and side 414. In some embodiments, curvature 430 is located between side 412 and side 414 but does not extend all the way between side 412 and side 414. In some embodiments, the curvature 430 in a convex curvature. In some embodiments, the curvature 430 of the curved portion 432 is designed to curl one or more of natural lashes or one or more artificial lash extensions arranged (or affixed to) at the natural lashes, such as at the underside of the natural lashes. In some embodiments, the curved portion 432 can extend between all or majority (e.g., greater than 50%) of the area between end portion 424 and end portion 426 of section 410.

In some embodiments, one or more of the interior surface or exterior surface of section 410 of electric applicator 400 can include or be formed of a non-stick material, such a silicone, polytetrafluoroethylene (PTFE), or other non-stick material. In some embodiments, the material of one or more of the interior surface or exterior surface of section 410 of electric applicator 400 can include a thermally conductive material, such as a thermally conductive silicone. In some embodiments, section 410 can also include one or more metals, such as aluminum, hardened steel, stainless steel coated with or without a non-stick material.

In some embodiments, rotational axis 422 is described as an axis (e.g., horizontal axis) and can be used as a reference to describe other positional relationships. Rotational axis 422 can extend from the proximal end 404 in the direction of the distal end 436. In some embodiments, rotational axis 422 can extend through section 406 and section 408 of electric applicator 400. Electric applicator 400 can be rotated around the rotational axis to different orientations, such as the aligned orientation or rotated orientation as described further below.

In some embodiments, electric applicator 400 can be configured in an open position, as illustrated by electric applicator 400 of FIG. 4A. In some embodiments, the open position of electric applicator 400 is the default position. In some embodiments, in the open position the respective sections 410 of each arm 402 do not contact one another. In the open position, the pair of opposing arms 402 are separated from one another.

Figure 4B:
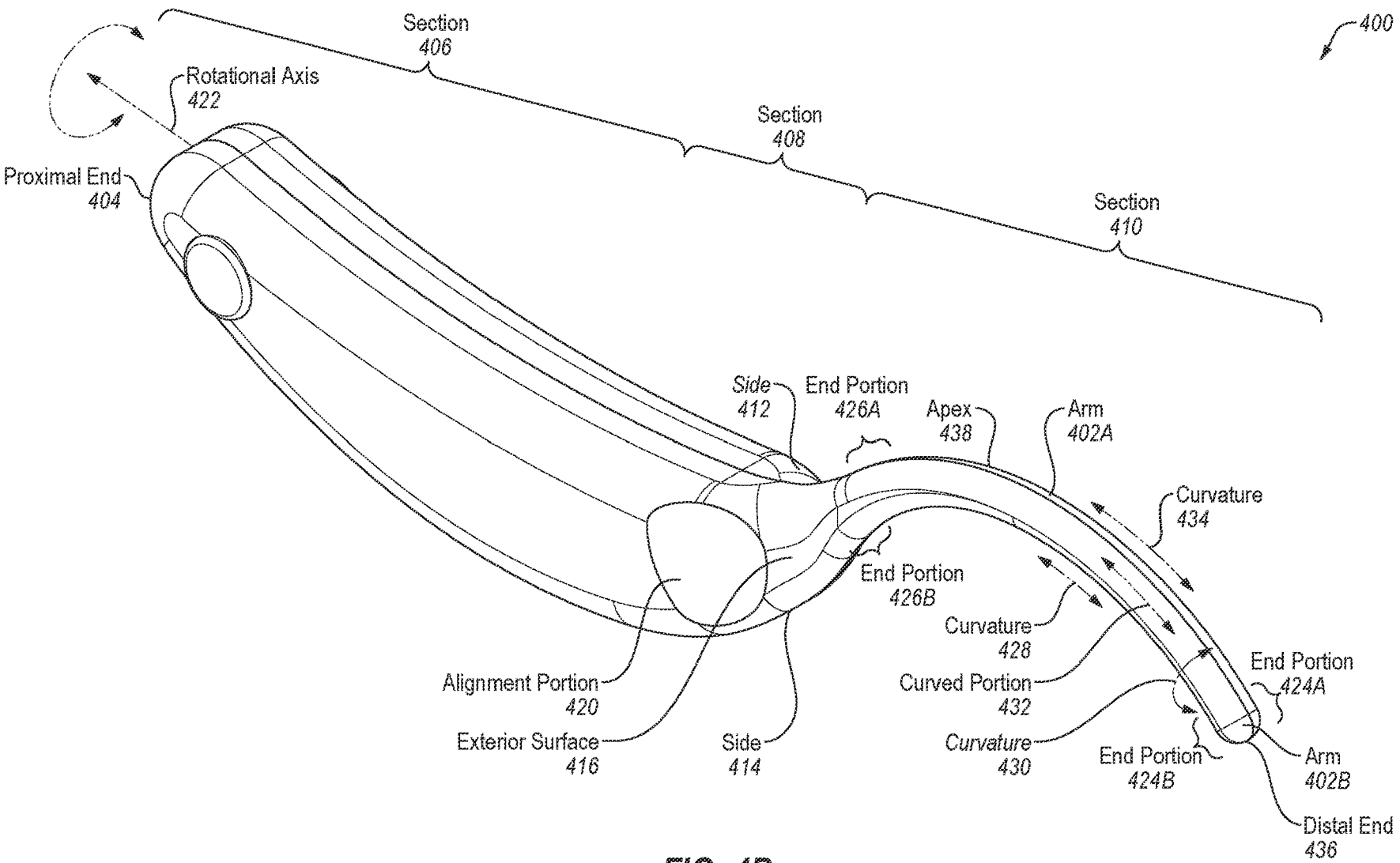
FIG. 4B is an illustration of an electric applicator in a closed position, in accordance with some embodiments of the disclosure.

FIG. 4B is an illustration of an electric applicator in a closed position, in accordance with some embodiments of the disclosure. In some embodiments, electric applicator 400 is configured to transition from an open position to a closed position, and vice versa. In some embodiments, transitioning from the open position to the closed position is responsive to an application of pressure to the pair of opposing arms 402. In some embodiments, in the closed position the interior surface 418 of section 410 of arm 402A is configured to contact the opposing interior surface 118 of arm 402B. In some embodiments, the substantially flat portion of the interior surface 418 of section 410 of arm 402A is configured to contact the substantially flat portion of opposing interior surface 118 of arm 402B. In some embodiments, the entire substantially flat portion extending the length (or at least between end portion 424 and end portion 426) of the curvature 428 of section 410 of arm 402A is configured to contact the substantially flat portion of opposing interior surface 118 of arm 402B. In some embodiments, the substantially flat portions allow the electric applicator 400 to apply substantially even pressure across the flat portions and to the natural lashes and/or multiple artificial lash extensions that are being squeezed between the opposing arms 402 of the electric applicator 400.

Figure 4C:
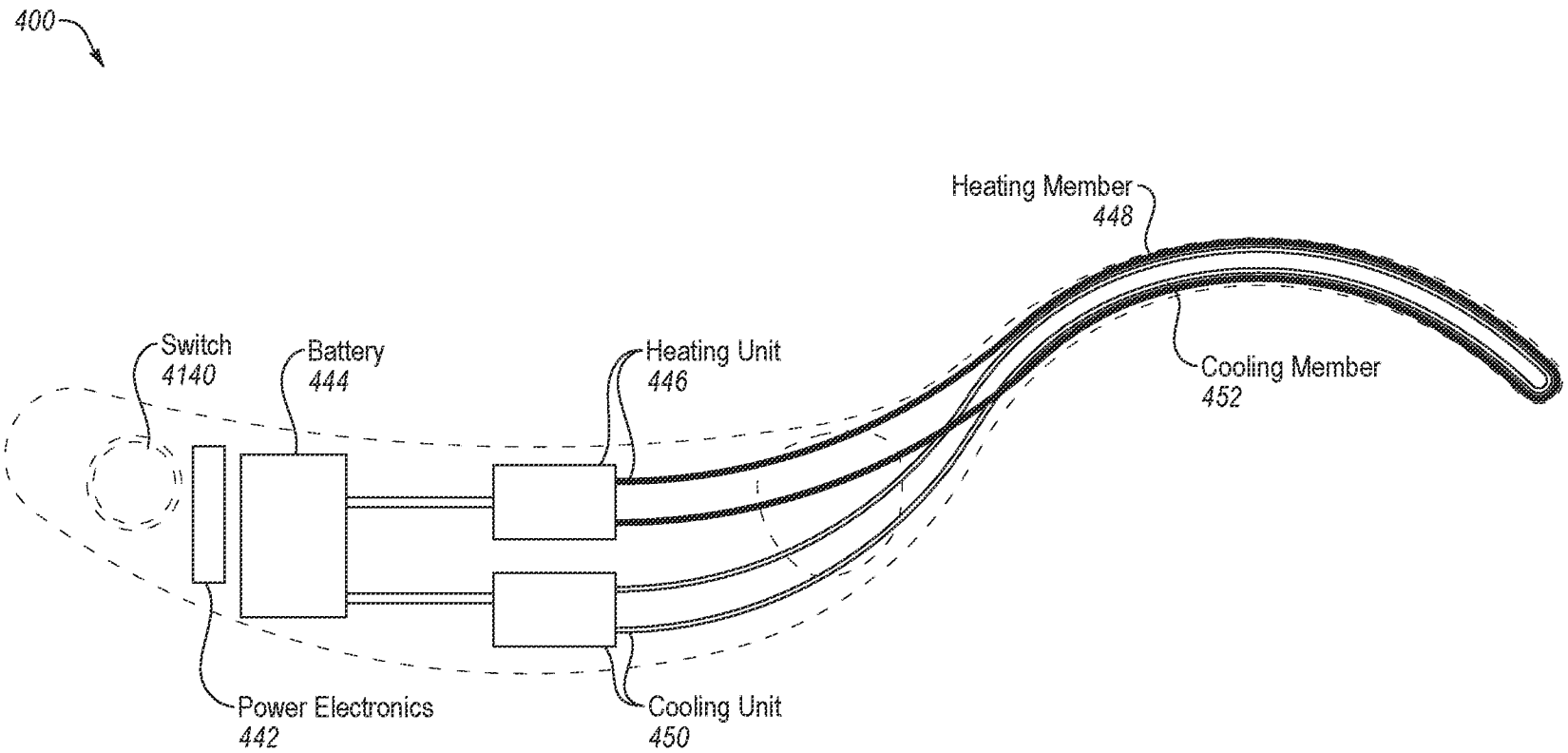
FIG. 4C is an illustration of the electrical components of the electric applicator, in accordance with some embodiments of the disclosure.

FIG. 4C is an illustration of electric components of the electric applicator, in accordance with some embodiments of the disclosure. In some embodiments, electric applicator 400 can include one or more electric components or one or more electronic components.

In one embodiment, electric applicator 400 includes a heating unit 446. Heating unit 446 in configured to provide heat to at least the first section 410 of each arm 402. Heating unit 446 can heat the interior surface 418 and/or the exterior surface 416 of section 410 of each arm 402. In some embodiments, heating unit 446 can heat the respective surfaces of section 410 of each arm 402 to one or more temperatures in a range of temperatures from 77 Fahrenheit (F) to 255 F (e.g., 120 F to 205 F). In some embodiments, the temperature can be selected at one or more of range of temperatures using for example, switch 440.

In some embodiments, the electric applicator 400 can include a temperature indicator that indicates the temperature of the electric applicator 400. For example, the temperature of the electric applicator 400 (e.g., at the respective surfaces of section 410 of each arm 402) can be displayed on a display (not shown) of the electric applicator 400. The display can include a liquid crystal display, for example.

In some embodiments, the heating unit 446 can include or be coupled to a heating member, such as heating member 448. In some embodiments, heating member 448 can be disposed within each arm 402 of electric applicator 400. In some embodiments, the heating member extends within section 410 of each arm 402. In some embodiments, the heating member conducts thermal energy (e.g., heat) to section 410 of each arm 402. In some embodiments, the heating member 448 can include a resistor wire. In some embodiments, the resistor wire is made out of a non-magnetic nickel and chromium alloy, an iron-nickel-aluminum or iron-chromium-aluminum alloy. In some embodiments, the resistivity of the resistor wire is in a range of 0.1 to 0.5 (e.g., 0.225) ohms per centimeter ($\Omega$cm−1). In some embodiments, the diameter of the resistor wire is in the range of 0.1 mm to 2 mm (e.g. the diameter being selected as a function of the operating temperature of the electric applicator 400).

In some embodiments, electric applicator 400 can include a cooling unit 450. Cooling unit 450 can be configured to cool at least the interior surface 418 and/or the exterior surface 416 of section 410 of each arm. In some embodiments, cooling unit 450 cools the aforementioned surfaces below room temperature. In some embodiments, cooling unit 450 can cool the aforementioned surfaces to one or more temperatures within a temperature range of 25 F to 65 F. In some embodiments, electric applicator 400 can be set to cool at one or more temperatures of the temperature range.

In some embodiments, the cooling unit 450 includes or is coupled to a cooling member 452. In some embodiments, the cooling unit 450 can conduct thermal energy away from the cooling member 452 and away from the medium surrounding the cooling member 451. In some embodiments, the cooling member 452 extends within section of each arm 402.

In some embodiments, the heating unit 466 can include a thermoelectric component (TEC). In some embodiments, the TEC can utilize a Peltier effect to apply a heating or cooling at a surface of the TEC. In some embodiments, the TEC can be a Peltier device. In some embodiments, the TEC can include an array of alternating n-type and p-type semiconductors disposed between two plates, such as two ceramic plates. A voltage applied to the TEC causes one plate to cool and the opposite plate to heat. For example, a voltage can be applied to the TEC such that one plate produces heat and the opposite plate cools. The heating member 448 can be thermally coupled to the heated plate of the TEC, and the thermal energy produced to the TEC can be transferred to the heating member 448.

In some embodiments, the cooling unit 450 can also include a TEC. In some embodiments, the TEC of the cooling unit 450 can be different than the TEC of the heating unit. In some embodiments, the TEC of the cooling unit 450 can be the same TEC as used in the heating unit 446. In some embodiments, only one of the heating unit 446 or the cooling unit 450 includes a TEC. In some embodiments where the cooling unit 450 includes a TEC, a voltage can be applied to the TEC to cool one plate of the TEC. The cooling member 452 can be thermally coupled to the cooled plate and thermal energy can be removed from the cooling member and/or the medium surrounding the cooling member 452.

In some embodiments, the cooling member 452 and the heating member 448 are different members. In some embodiments, the heating member 448 and the cooling member 452 are the same member. In an illustrative example, a heating/cooling member can be thermally coupled to one side of the TEC. The voltage polarity coupled to the TEC can switch so that the thermally coupled plate of the TEC can switch from heating to cooling and vice versa as desired.

In some embodiments, electric applicator 400 includes a power source, such as a battery 444. In some embodiments, battery 444 can be a rechargeable battery. In other embodiments, the battery 444 can be a disposable battery, such as an alkaline battery, that can be replaced by a user, for example.

In some embodiments, electric applicator 400 includes one or more power electronics 442 that converts external energy to usable energy for battery 444. For example, battery 444 can be charged using an induction charger. Power electronics 442 can include a coil and other suitable electronics that harvests magnetic energy transmitted by the induction charger. In some embodiments, the power electronics 442 can include an AC to DC converter (and/or rectifier). For example, electric applicator 400 can be have a physical connection (e.g., wire) to an electrical outlet. The power electronics 442 can convert AC power to constant or pulsed DC that charges the battery 444 or directly powers electric applicator 400 (e.g., heating unit 446 and/or cooling unit 450).

In some embodiments, electric applicator 400 includes switch 440. Switch 440 can function to turn electric applicator 400 on or off. In some embodiments, switch 440 can control the state of electric applicator 400 from a cooled state (e.g., cooled mode) to a heated state (e.g., heated mode), and vice versa. In some embodiments, switch 440 can control the temperature in one or more of the cooled state or heated state. For example, the switch 440 can be a rotary switch that allows the user to rotate the switch to control the temperature of the electric applicator 400 in the cooled state or heated state. In some embodiments, switch 440 is electrically coupled to one or more of battery 444, heating unit 446, or cooling unit 450.

In some embodiments, electric applicator 400 includes an off timer (not shown). After the temperature of the heating unit 446 or cooling unit 450 reaches the set temperature, switch 440 in the on position automatically goes to the off position in a preset time (e.g., 5 minutes later) to cut off the power to one or more of the heating unit 446 or cooling unit 450.

FIGS. 5A-5G are illustrations showing operations for affixing artificial lash extensions to natural lashes and using the electric applicator to curl the affixed natural lashes, in accordance with some embodiments of the disclosure. Elements of the preceding figures are referenced with respect to the description of FIGS. 5A-5G for purposes of illustration, rather than limitation.

Figure 5A:
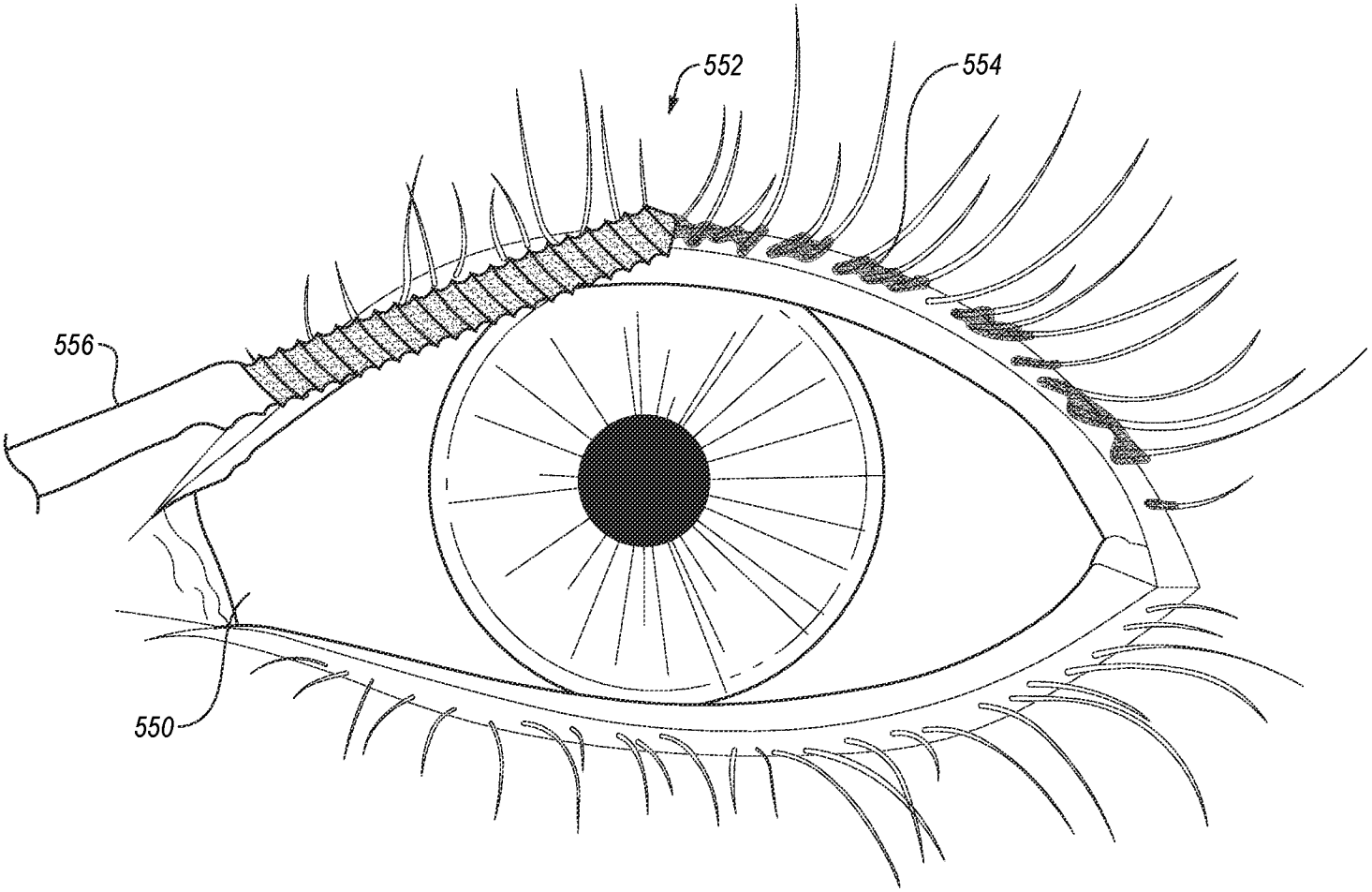
FIGS. 5A-5G are illustrations showing operations for affixing artificial lash extensions to natural lashes and using the electric applicator to curl the affixed artificial lash extensions, in accordance with some embodiments of the disclosure.

FIG. 5A illustrates an application of an adhesive to the natural lashes, in accordance with some embodiments of the disclosure. FIG. 5A shows the adhesive 554 applied using adhesive application tool 556 (e.g., a brush) to the underside of the upper natural lashes 552 of an eye 550. The adhesive may include one or more of a glue, a mascara, a bonding agent, an epoxy, a paste, or any other natural or synthetic substance having an adhesive quality.

Figure 5B:
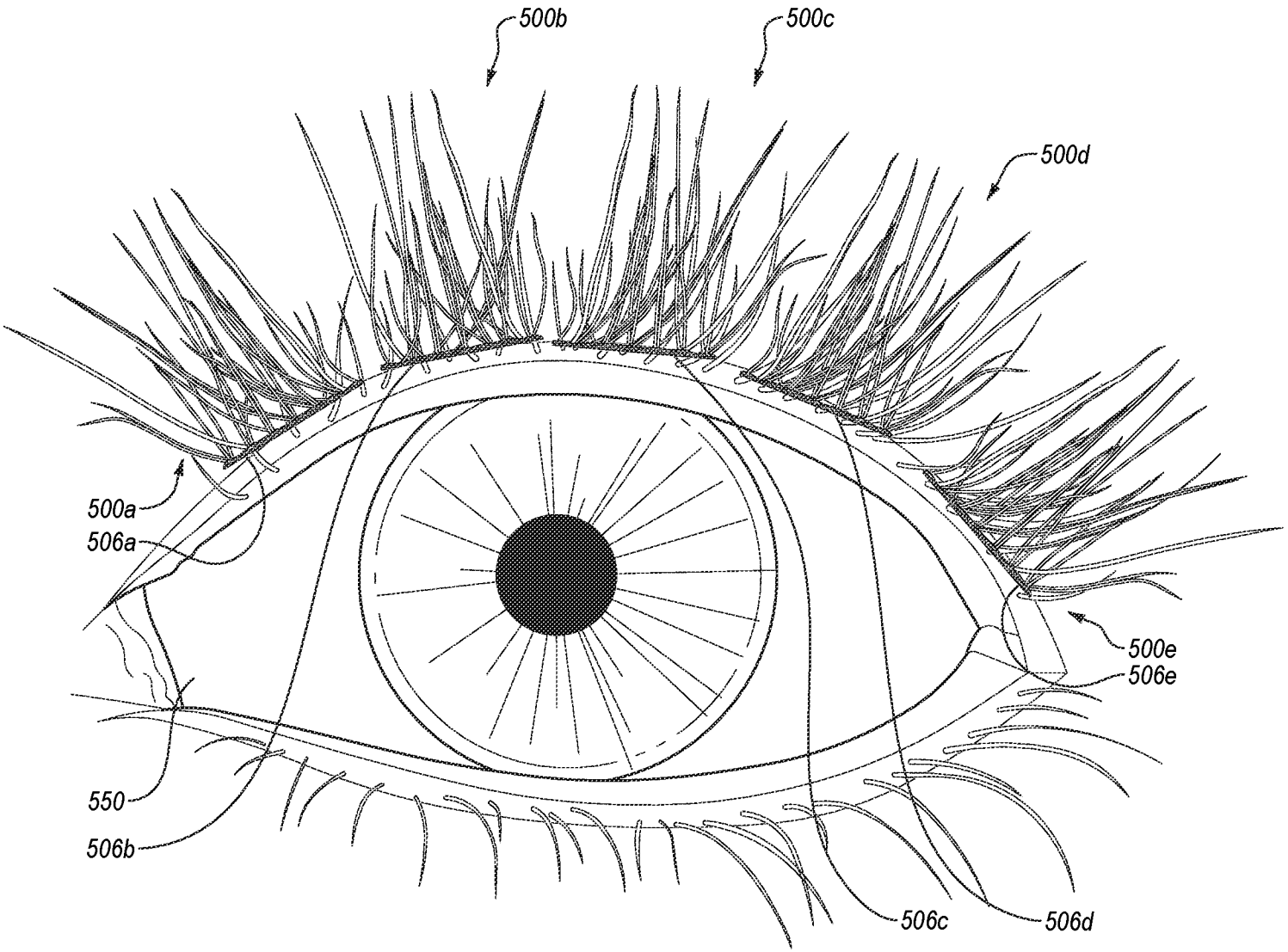

FIG. 5B illustrates the arrangement of artificial lash extensions at the natural lashes, in accordance with some embodiments of the disclosure. FIG. 5B shows a first set of artificial lash extensions 500A-E (generally referred to as "artificial lash extensions 500" herein) arranged at the underside of the natural lashes of the user's eye. In some embodiments, each of artificial lash extensions 500A-E including bases 506A-E, respectively. The bases 506A-E can be arranged at the underside of the natural eyelashes 552. In some embodiments, bases 506A-E are arranged proximate to the lash line of the eye 550. In some embodiments, at least a part of the top side of bases 506A-E are attached (via the adhesive) to the underside of the natural lashes 552. In some embodiments, at least part of some of the artificial hairs of the artificial lash extensions 500 are attached (via the adhesive) to the underside of the natural lashes 552. It should be understood that the size, number of artificial lash extensions and type of artificial lash extension are shown for purposes of illustration, rather than limitation. In some embodiments, any number of artificial lash extensions can be attached to the natural lashes. Although the artificial lash extensions are shown as segments of a given size, in other embodiments the artificial lash extension can be larger segments (or smaller segments) that extend, for example, across approximately half of the lash line (e.g., two artificial lash extensions can cover the upper lash). In still other embodiments, a single artificial lash extension can substantially cover the lash line. In some embodiments, a different type of artificial lash extension can be used.

Figure 5C:
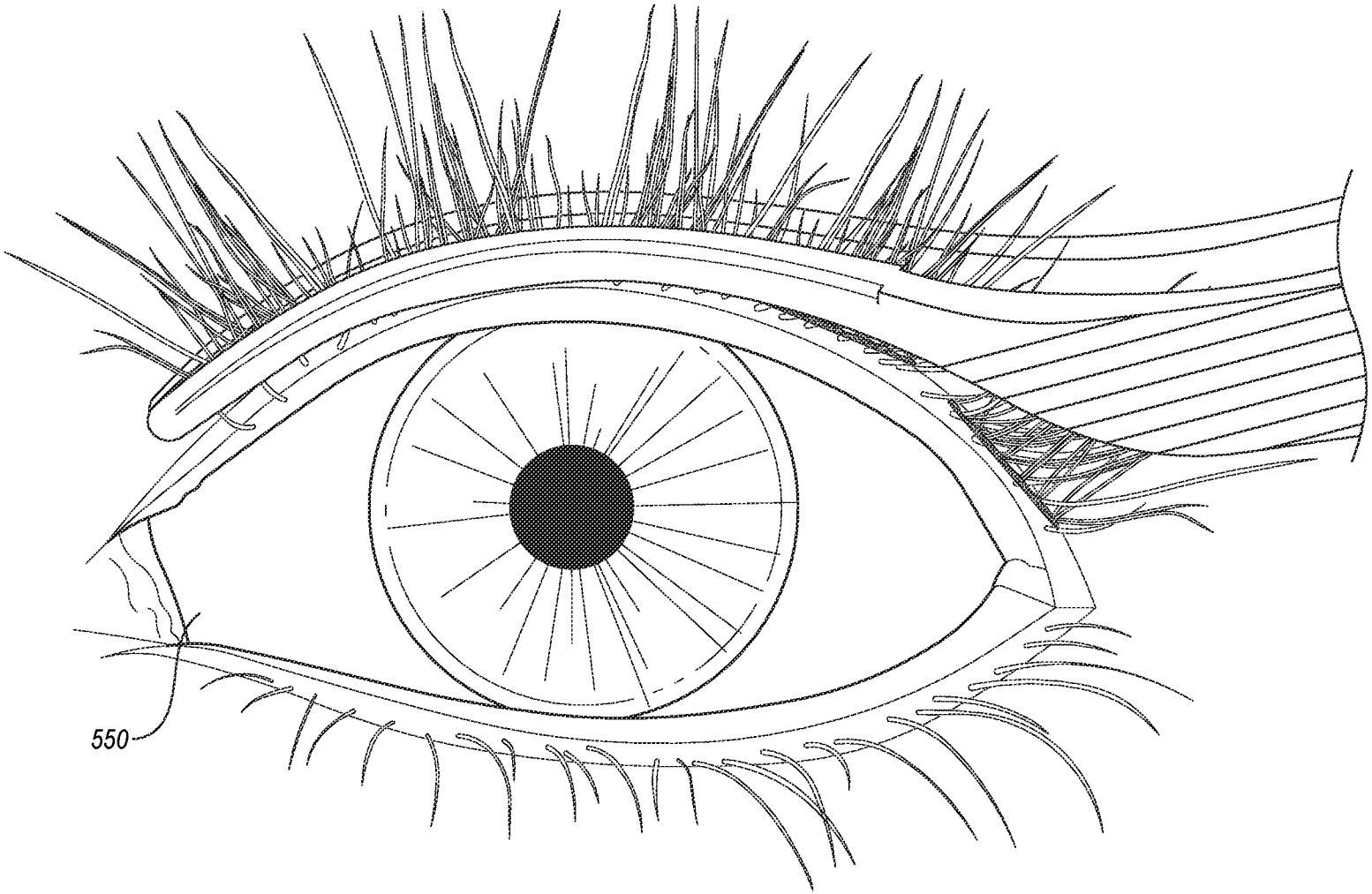

FIG. 5C illustrates the artificial lash extensions being affixed to the natural lashes, in accordance with some embodiments of the disclosure. FIG. 5C shows the artificial lash extensions 500A-E being affixed to the underside of the natural lashes using an applicator. The applicator as illustrated can be the same or different applicator as described herein. For example, a purely mechanical applicator can be used to affix the artificial lash extensions to the underside of the natural lashes. In some embodiments, the interior surfaces of the arms of the applicator can apply pressure to the artificial lash extensions and natural lashes and cause the artificial lash extensions to have a more secure bond with the natural lashes (more secure than if the additional pressure were not applied). The application of pressure can cause the bonded surfaces of the artificial lash extensions and the natural lashes to increase (more than if the application of pressure where not applied). In some embodiments, pressure can be applied to the applicator by a user that causes the opposing arms to come together and apply pressure to the artificial lash extensions, adhesive, and natural lashes therebetween. The pressure can help secure or bond the artificial lash extension to the natural lashes.

In some embodiments, electric applicator 400 is used to affix the artificial lash extensions to the natural lashes. The electric applicator 400 can be in the heated state, the cooled state, or the off state when affixing the artificial lash extensions to the natural lashes.

Figure 5D:
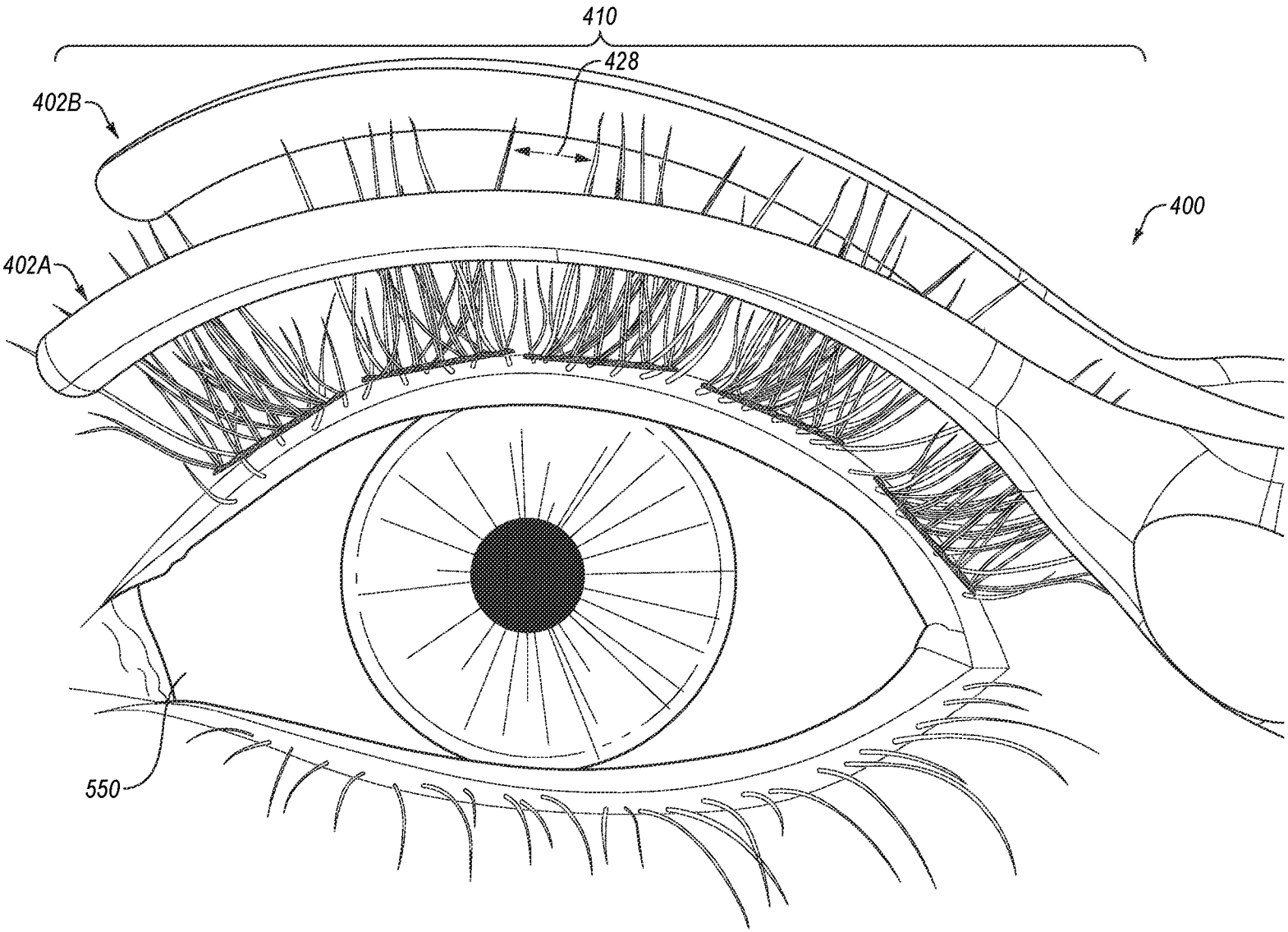

FIG. 5D illustrates the positioning of the electric applicator in an aligned orientation, in accordance with some embodiments of the disclosure. FIG. 5D shows the heated electric applicator 400 positioned in an aligned orientation at the eye area. In the aligned orientation, the curvature 428 of each arm 402 is aligned with the lash line of the natural lashes. In some embodiments and not shown in FIG. 5D, the electric applicator 400 is obtained and activated such that the heating unit of the electric applicator 400 is activated to heat the section 410 of each arm 402 to the desired temperature. As illustrated, the electric applicator 400 can be positioned in the aligned orientation while in the open position.

Figure 5E:
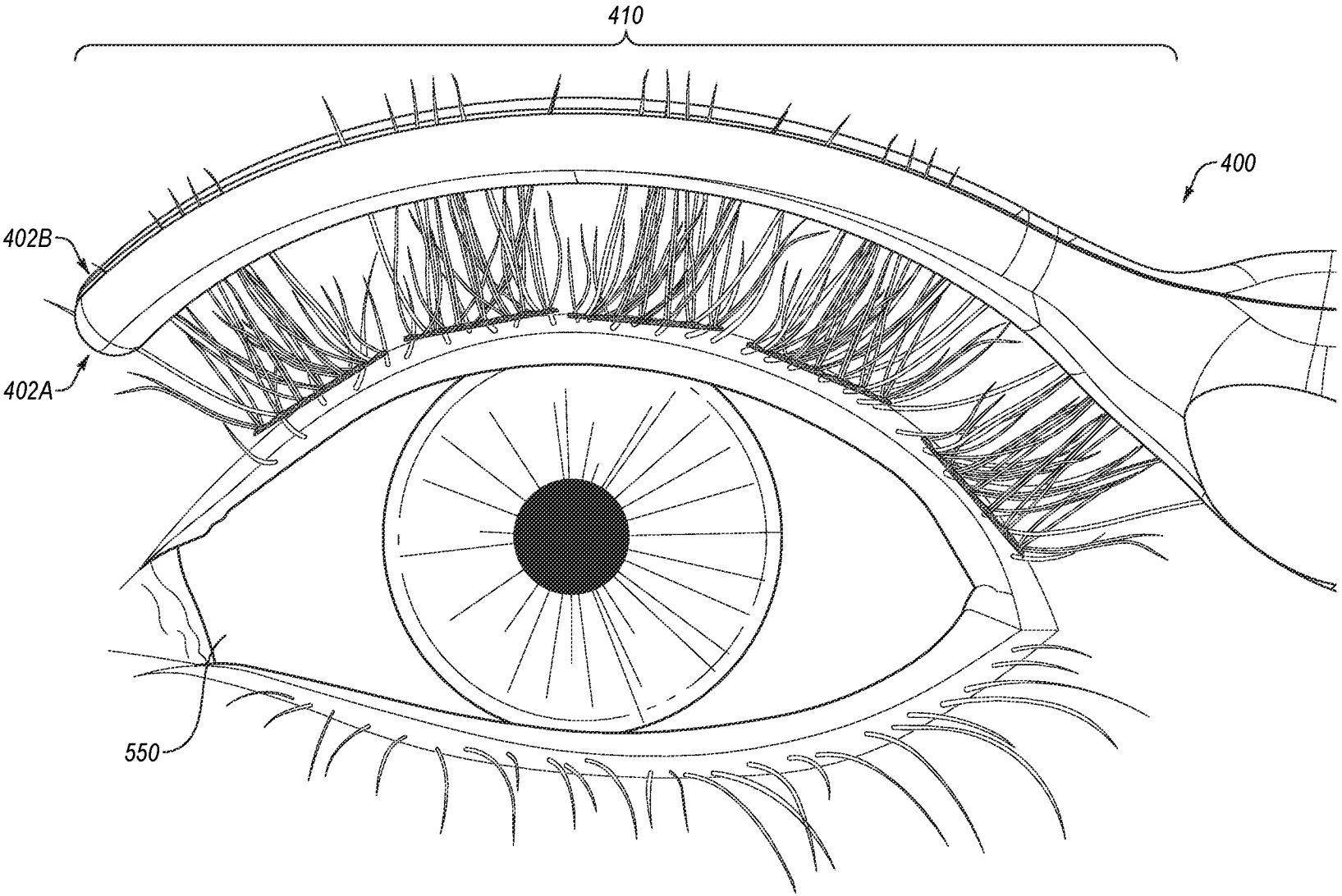

FIG. 5E illustrates a transition of the electric applicator to a closed position, in accordance with some embodiments of the disclosure. FIG. 5E shows the heated electric applicator 400 transitioned from the open position (e.g., shown in FIG. 5D) to a closed position by closing the section 410 of the pair of opposing arms 402 on the natural lashes and artificial lash extensions 500 that are attached (e.g., affixed) to the natural lashes. In some embodiments, an in particular to curl one or more of the natural lashes or artificial lash extensions 500, the heated electric applicator 400 can be positioned towards or closer to the ends of the natural lashes or artificial lash extensions 500 (e.g., away from the lash line or base, respectively). The heated electric applicator 400 in the closed position is shown in the aligned orientation.

Figure 5F:
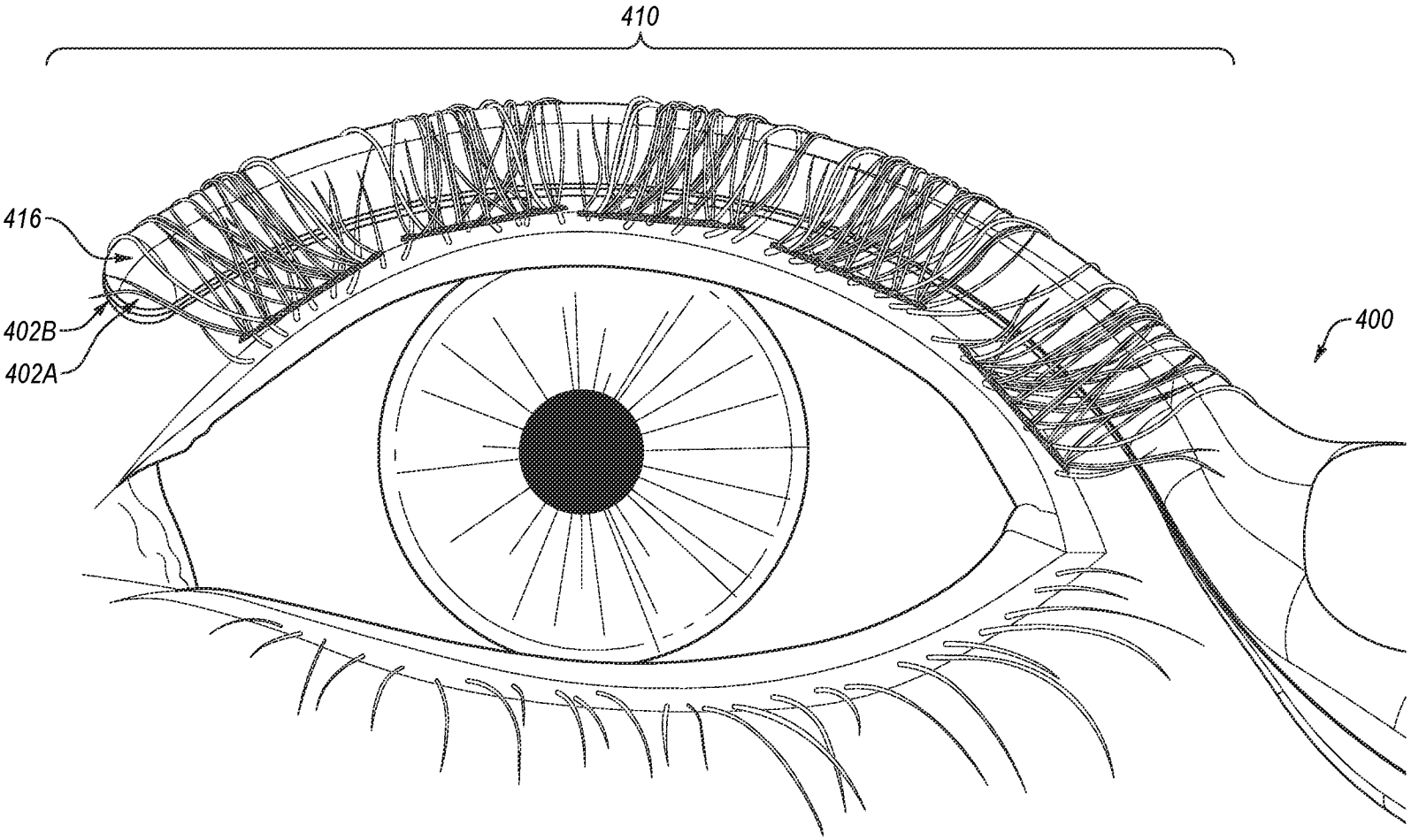

FIG. 5F illustrates a rotation of the heated electric applicator to the rotated orientation, in accordance with some embodiments of the disclosure. In some embodiments, the heated electric applicator 400 is rotated in the closed position along a rotational axis to transition the heated electric applicator 400 from the aligned orientation to the rotated orientation. In the rotated orientation, at least part of the natural lashes and at least part of the artificial lash extensions contact the exterior surface 416 of section 410 of at least one of the pair of the opposing arms 402 of the heated electric applicator 400. In some embodiments, one or more of the interior surface 418 or the exterior surface 416 of section 410 of the heated electric applicator 400 are heated to a desired temperature in the heated state. As illustrated, the exterior surface 416 of section 410 has a curvature 430 that helps curl one or more of the natural lashes or artificial lash extensions.

In some embodiments, the heated electric applicator 400 is maintained in the rotated orientation and in the closed position for a time period (e.g., 5-60 seconds) to curl (e.g., set the curl so the curl stays after the electric applicator 400 is removed) one or more of the natural lashes or artificial lash extensions 500.

Curling the artificial lash extensions is shown for purposes of illustration, rather than limitation. In some embodiments, the electric applicator 400 can be used to curl natural lashes without artificial lash extensions in a similar manner as described herein.

Figure 5G:
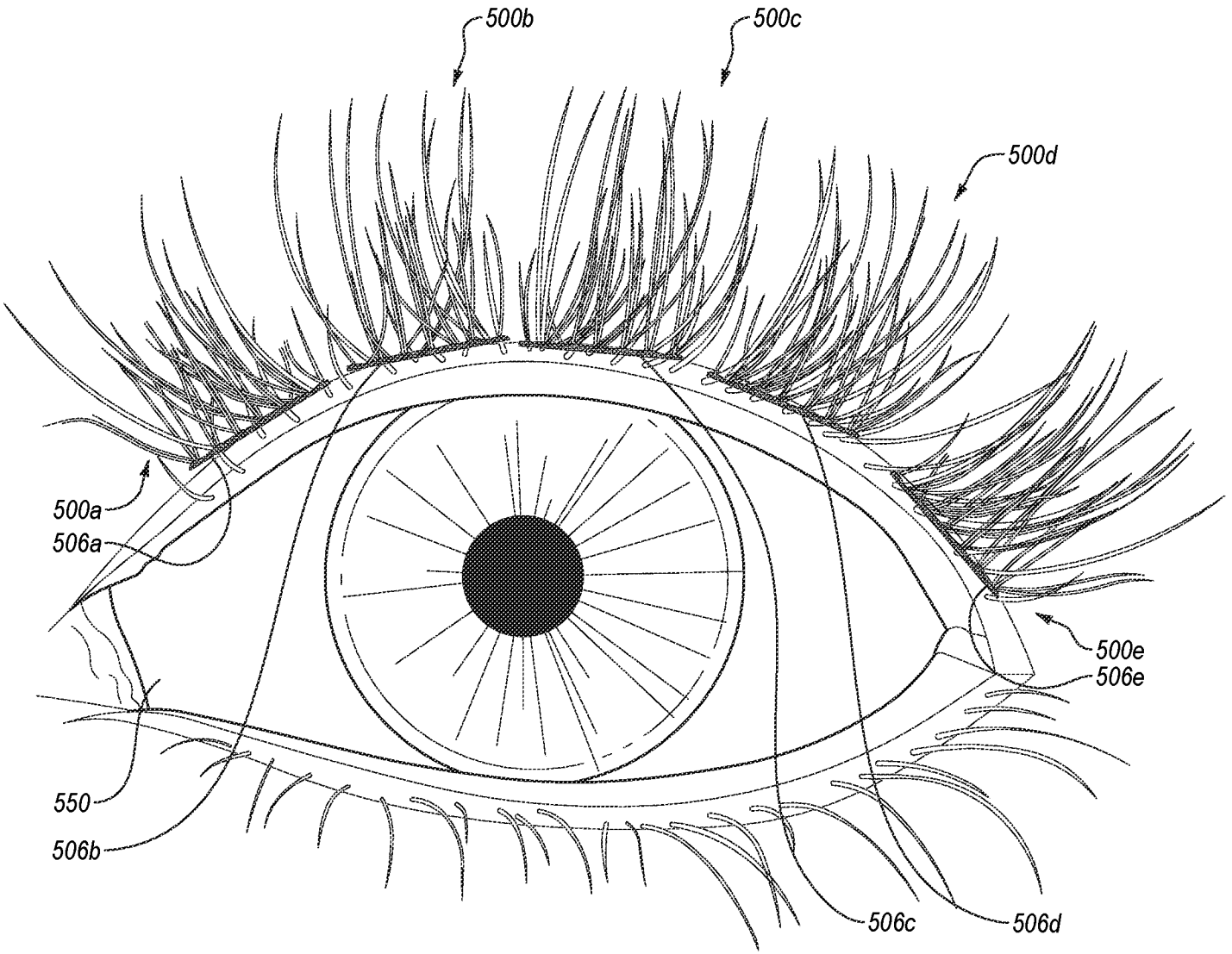

FIG. 5G illustrates the curled artificial lash extensions and natural lashes, in accordance with some embodiments of the disclosure. In some embodiments, after maintaining the heated electric applicator 400 in the closed position and rotated orientation for a time period, the heated electric applicator 400 can be removed to reveal one or more of the natural lashes or artificial lash extensions 500 in a curled position (e.g., at least more curled than before the above operations were performed to curl the artificial lash extensions or natural lashes).

FIGS. 6A-6F are illustrations showing operations for re-affixing artificial lash extensions to natural lashes, in accordance with some embodiments of the disclosure. Elements of the preceding figures are referenced with respect to the description of FIGS. 6A-6F for purposes of illustration, rather than limitation.

Figure 6A:
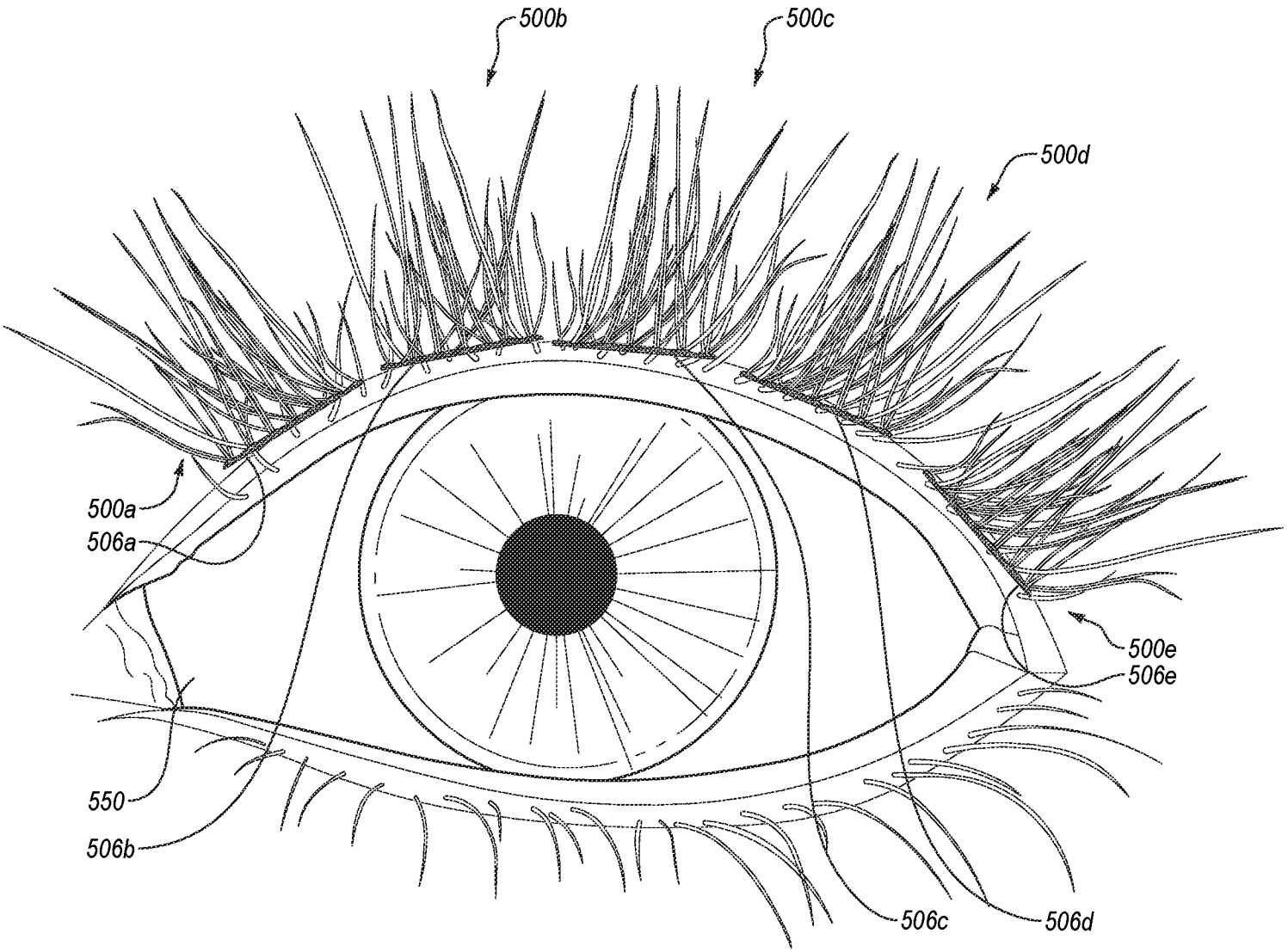
FIGS. 6A-6F are illustrations showing operations for re-affixing artificial lash extensions to natural lashes, in accordance with some embodiments of the disclosure.

FIG. 6A illustrates artificial lash extensions that have been attached to the natural lashes, in accordance with some embodiments of the disclosure. In some embodiments, the artificial lash extensions 500 can be affixed or arranged to the natural lashes as described above with respect to FIGS. 5A-5C. For the sake or brevity, the description with respect to FIGS. 5A-5C can apply to FIG. 6A in some embodiments and is not repeated here. In some embodiments, the artificial lash extensions 500 can be curled as described herein. In other embodiments, the artificial lash extension are not curled using the electric applicator 400.

In some embodiments, the artificial lash extensions 500 are attached (e.g., arranging and/or affixing) during a first application session. In some embodiments, the operations as described below with respect to FIGS. 6B through 6F are performed during a second application session. The second application session (re-affixing) can be performed after some time period (e.g., hours or days) after the performance of the first application session. In some embodiments, the re-affixing operation(s) of the second session can be performed to re-bond or enhance the bond between the artificial lash extensions and the natural lashes.

Figure 6B:
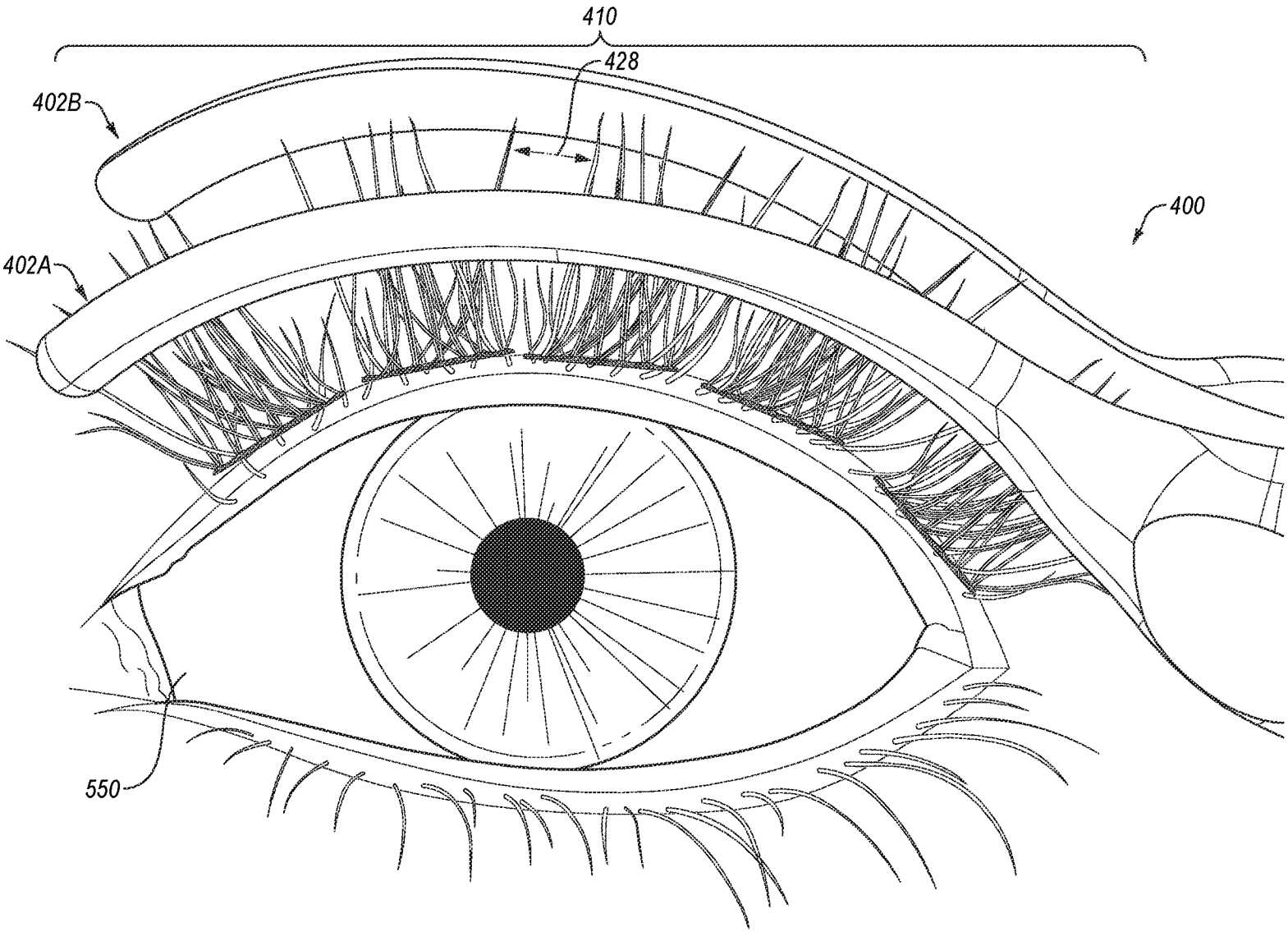

FIG. 6B illustrates the positioning of the electric applicator in an aligned orientation, in accordance with some embodiments of the disclosure. FIG. 6B shows the heated electric applicator 400 positioned in an aligned orientation at the eye area. In the aligned orientation, the curvature 428 of each arm 402 is aligned with the lash line of the natural lashes. In some embodiments and not shown in FIG. 6B, the electric applicator 400 is obtained and activated such that the heating unit of the electric applicator 400 is activated to heat the section 410 of each arm 402 to the desired temperature. The electric applicator 400 is also shown in the open position.

Figure 6C:
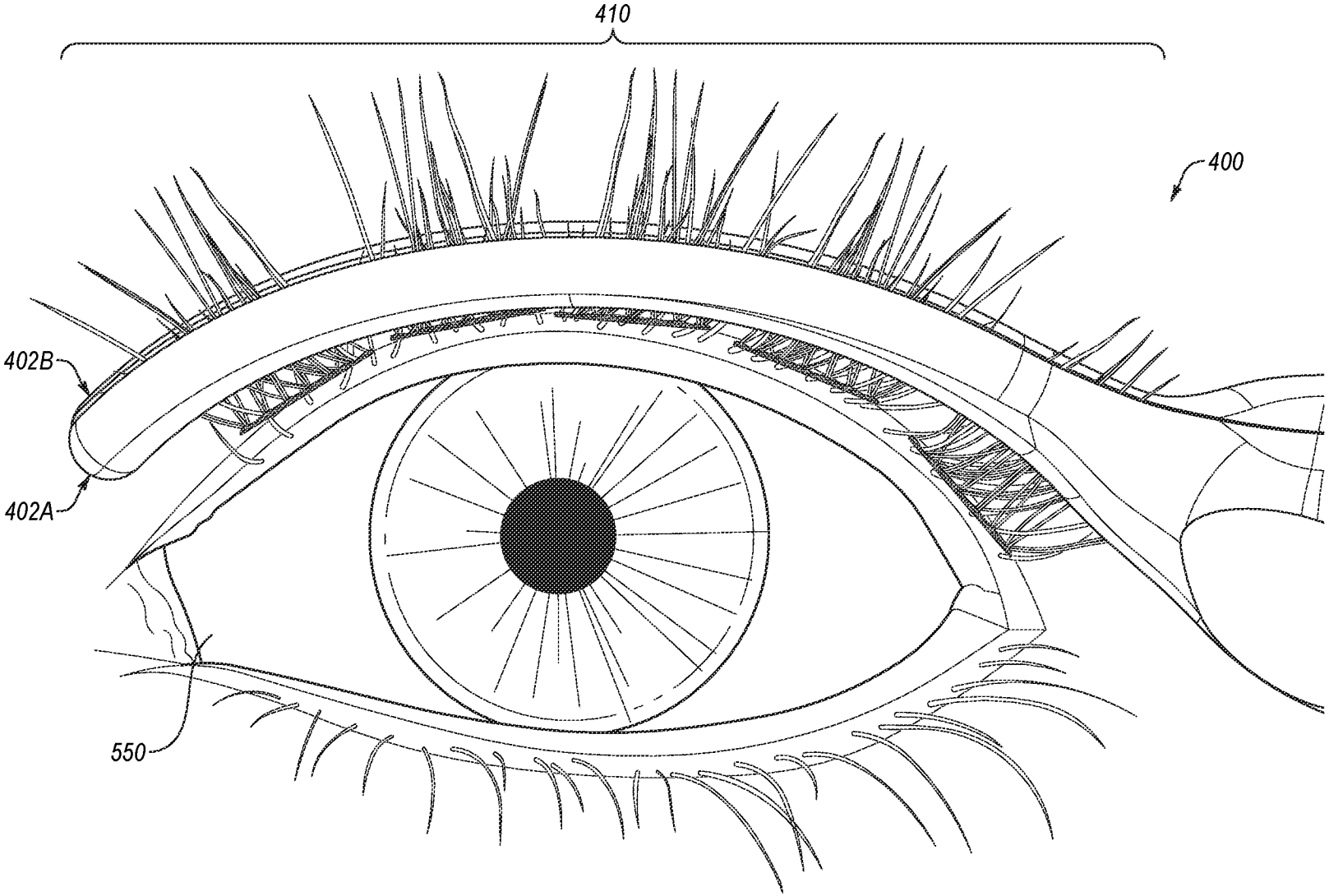

FIG. 6C illustrates transitioning the electric applicator to a closed position, in accordance with some embodiments of the disclosure. FIG. 6C shows the heated electric applicator 400 transitioned from the open position (e.g., shown in FIG. 6B) to a closed position by closing the section 410 of the pair of opposing arms 402 onto the natural lashes and artificial lash extensions 500 therebetween. In some embodiments, an in particular to re-affix the artificial lash extensions 500, the heated electric applicator 400 can be positioned towards or closer to the lash line the natural lashes or base of the artificial lash extensions 500 (e.g., away from the ends of the artificial lash extensions). The heated electric applicator 400 in the closed position is shown in the aligned orientation.

In some embodiments, to perform the re-affixing operation(s) the heated electric applicator 400 is maintained in the closed position (and in the aligned orientation or another orientation) for a time period (e.g., 5-300 seconds) to soften the adhesive used to attach (e.g., arrange and/or affix) the artificial lash extensions 500 to the natural lashes. In some embodiments, the adhesive can be the original adhesive (e.g., see FIG. 5A) used to arrange and affix the artificial lash extensions during the initial application session. In some embodiments, additional adhesive can be applied. In some embodiments, no additional adhesive is applied (e.g., additional to the initial application session). For example, the adhesive that bonds the artificial lash extensions to the natural lashes can be several days old and have hardened over that time period. The introduction of heat to the hardened adhesive can cause the adhesive to soften and reflow or redistribute the adhesive to different contact areas between the artificial lash extensions and natural lashes.

Figure 6D:
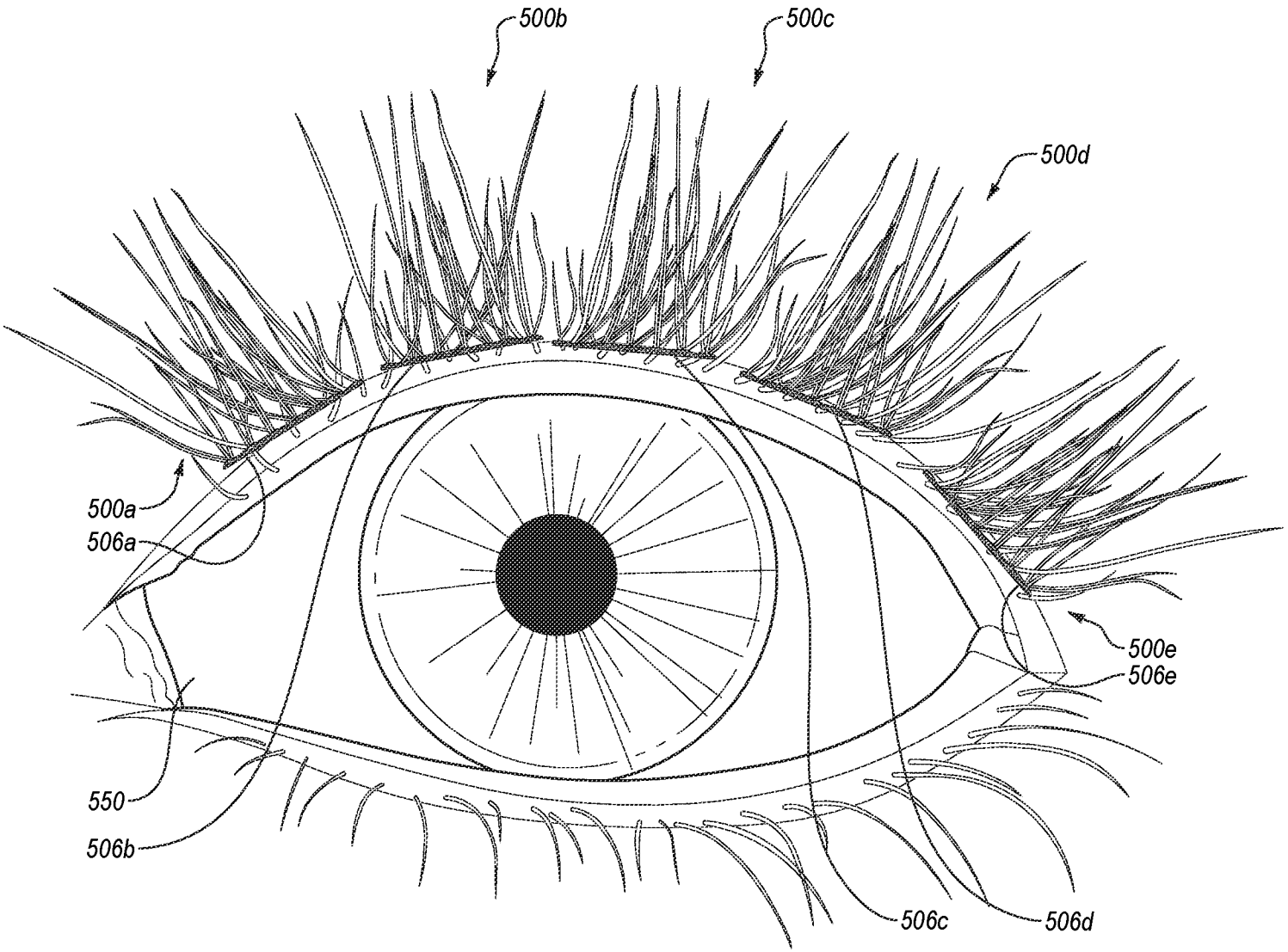

FIG. 6D illustrates artificial lash extensions after the heated electric applicator has been removed, in accordance with some embodiments of the disclosure. FIG. 6D shows the artificial lash extensions after the removal of the heated electric applicator 400 from the eye area. The adhesive has been heated and can still be sticky or tacky. In some embodiments, the cooling unit 450 of the electric applicator 400 can be activated to cool section 410 of each arm 402 of the electric applicator 400.

Figure 6E:
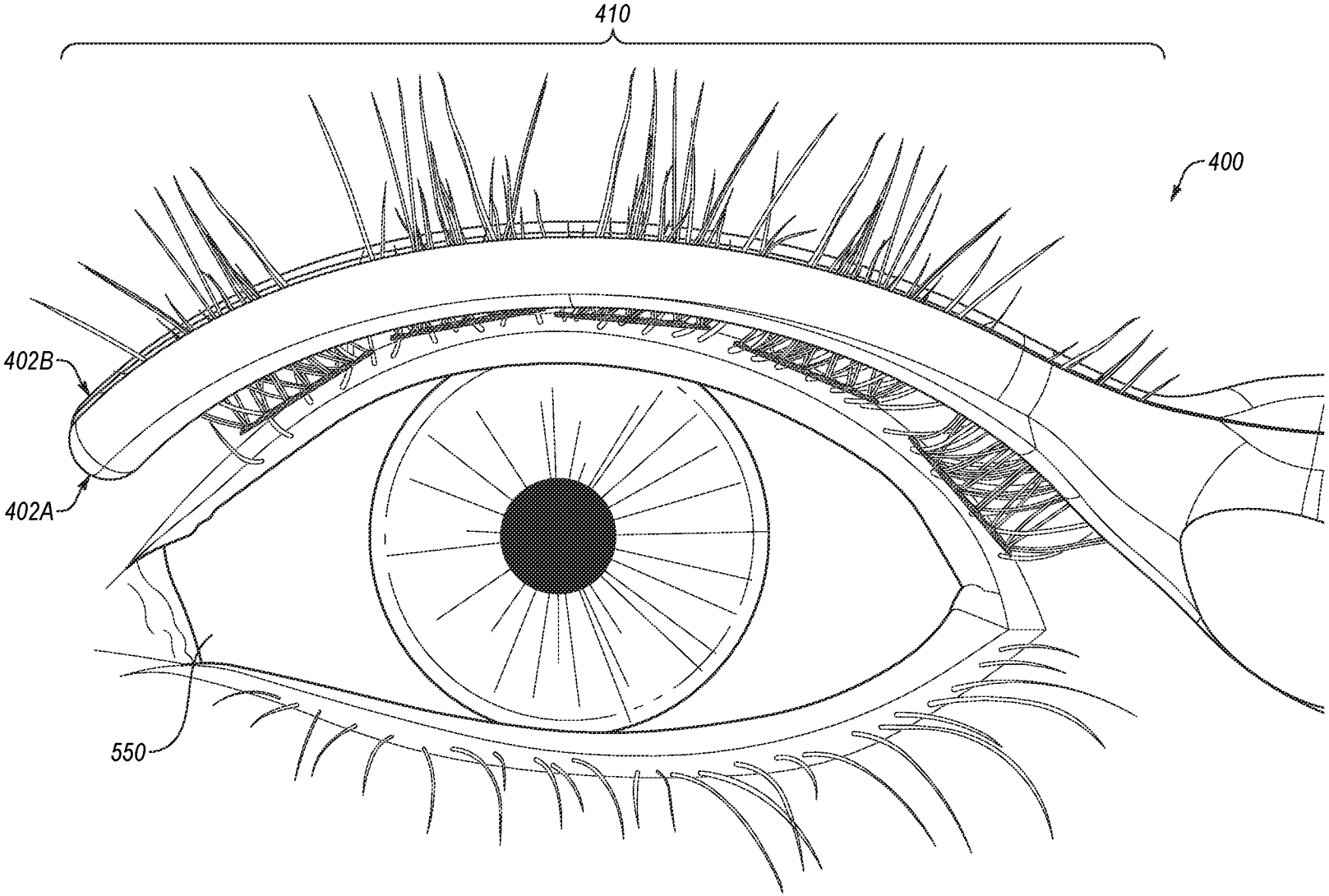

FIG. 6E illustrates the cooled electric applicator positioned in the aligned orientation and in the closed position, in accordance with some embodiments of the disclosure. In some embodiments, the cooled electric applicator 400 can be positioned in an aligned orientation at the eye area in the open position (not shown, but similar to FIG. 6B). In the aligned orientation, the curvature 428 of each arm 402 is aligned with the lash line of the natural lashes. In some embodiments, the cooling unit 450 of the electric applicator 400 is activated to cool the section 410 of each arm 402 to the desired temperature.

In some embodiments, the cooled electric applicator 400 is transitioned from the open position (e.g., similar to FIG. 6B) to a closed position by closing the section 410 of the pair of opposing arms 402 on the natural lashes and artificial lash extensions 500 that are attached (e.g., affixed) to the natural lashes. In some embodiments, an in particular to re-affix the artificial lash extensions 500, the cooled electric applicator 400 can be positioned towards or closer to the lash line of the natural lashes or base of the artificial lash extensions 500 (e.g., away from the ends of the artificial lash extensions). The cooled electric applicator 400 in the closed position is shown in the aligned orientation (but can be in a different orientation in some embodiments).

In some embodiments, to perform the re-affixing operation(s) the cooled electric applicator 400 is maintained in the closed position (and in the aligned orientation or another orientation) for a time period (e.g., 5-180 seconds) to harden the adhesive used to affix the artificial lash extensions 500 to the natural lashes. In some embodiments, the time between heating the adhesive and cooling the heated adhesive can be less than 5 minutes or at least during the same application session. By cooling the adhesive, the adhesive hardens to recreate and even improve the bond between the artificial lash extensions and the natural lashes.

Figure 6F:
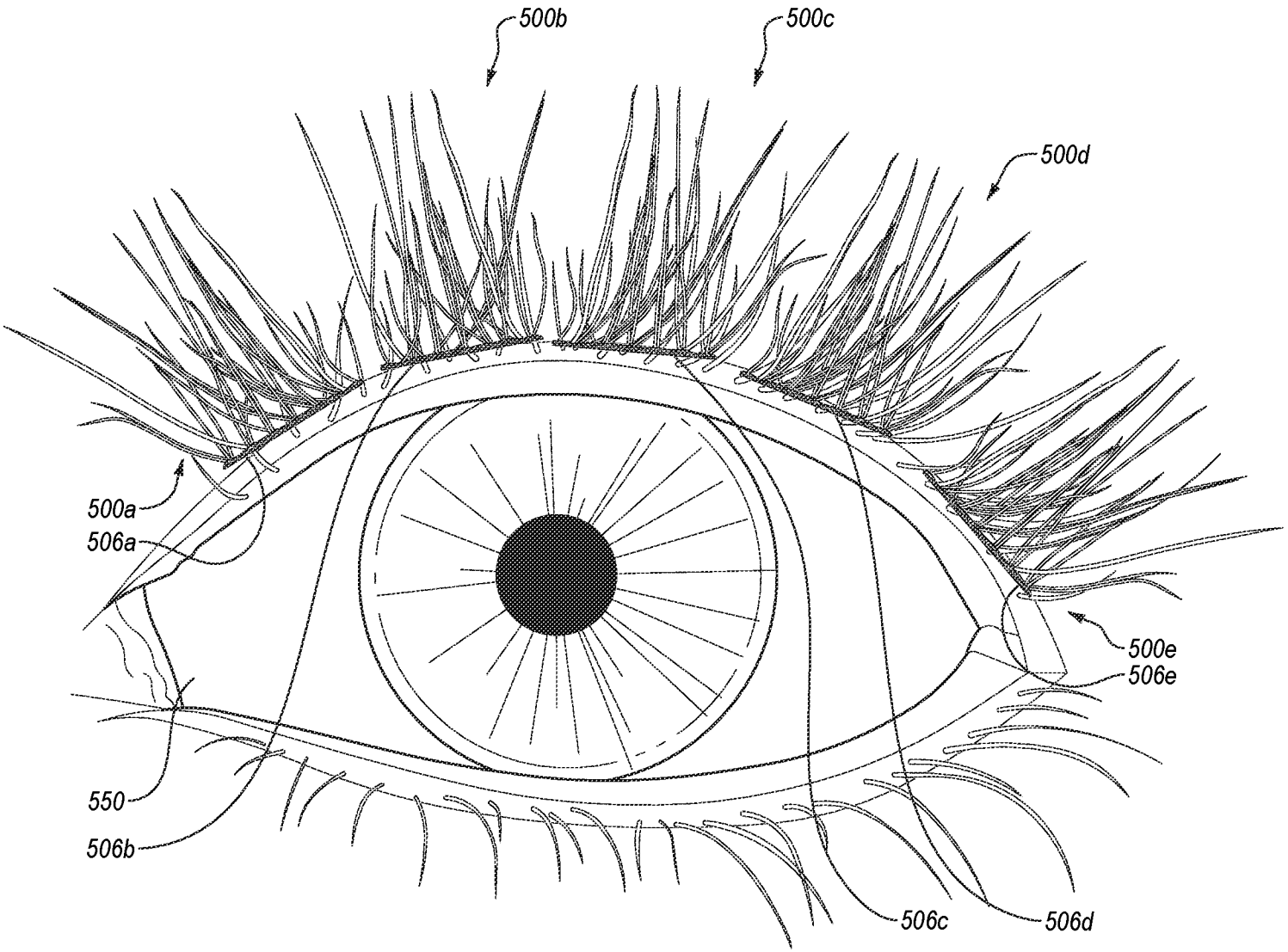

FIG. 6F illustrates artificial lash extensions after the cooled electric applicator has been removed, in accordance with some embodiments of the disclosure. FIG. 6F shows the artificial lash extensions after the removal of the cooled electric applicator 400 from the eye area. The adhesive has been heated and subsequently cooled. Although electric applicator 400 has been used to illustrate the cooling of the adhesive, in some embodiments a different applicator can be used. For example, a purely mechanical applicator (e.g., metal applicator) can be put in the freezer and subsequently be used to perform the cooling, as described herein.

Method 700 is described as a series of operations (or acts). It should be understood that some operations can be performed concurrently with other operations. In some embodiments, the same, fewer or greater number of operations can be performed in the same or different order. In some embodiments, different operations can be performed or the multiple operations can be combined into a single operation, or a single operation can be performed using multiple operations.

Figure 7A:
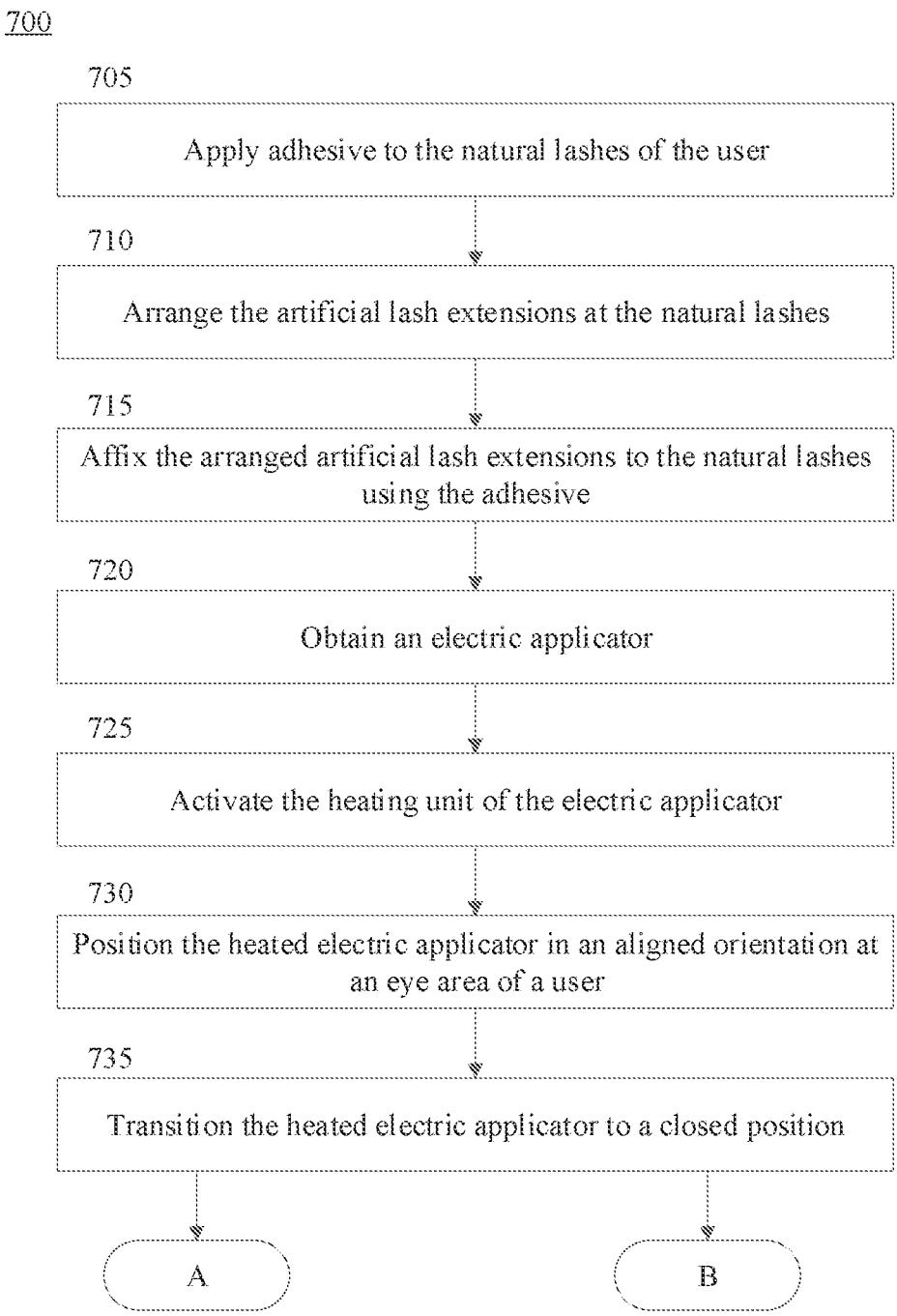
FIGS. 7A-7C are flow diagrams illustrating operations for affixing artificial lash extension, curling the artificial lash extensions and re-affixing the artificial lash extensions, in accordance with embodiments of the disclosure.
Figure 7B:
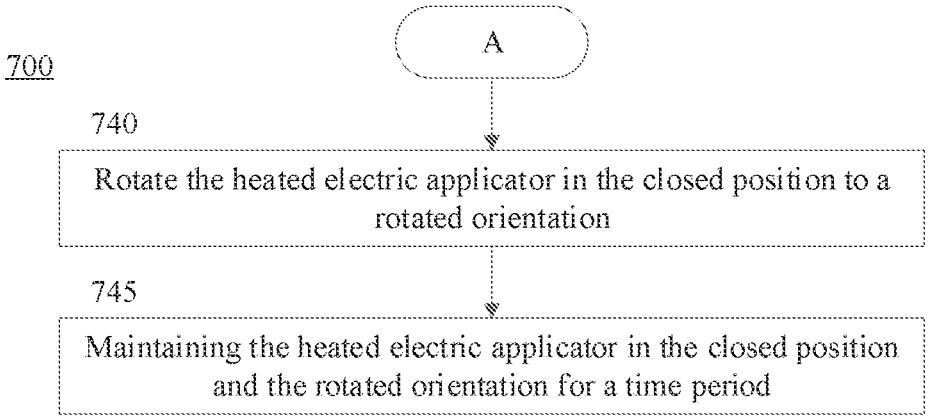
Figure 7C:
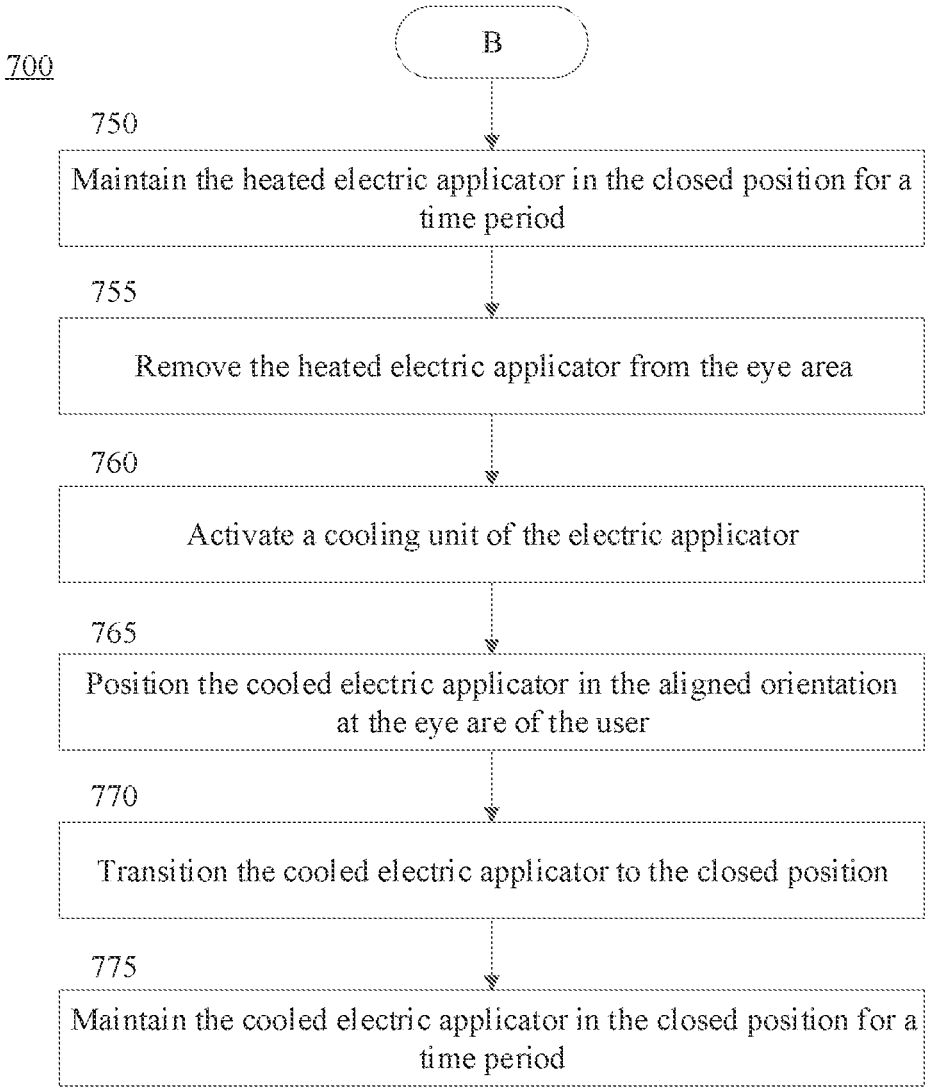

FIGS. 7A-7C are flow diagrams illustrating operations for affixing artificial lash extension, curling artificial lash extensions and re-affixing artificial lash extensions, in accordance with embodiments of the disclosure. Method 700 of FIGS. 7A-7C can be performed by a user. In some embodiments, the user can use an electric applicator 400, as described herein, or different applicator to perform at least some of the operations of method 700. The user of method 700 can be the same user on whom the artificial lash extensions are applied or another user that applies the artificial lash extensions on behalf of the user.

At operation 705 of method 700, an adhesive may be applied to natural lashes of a user. In some embodiments, the adhesive can be applied to the underside of the natural lashes, such as the underside of the upper natural lashes. In some embodiments, rather than the underside, the adhesive may be applied to the top or sides of the upper natural lashes.

In some embodiments, the adhesive may be one or more of a glue, a mascara, a bonding agent, an epoxy, a paste, or any other natural or synthetic substance having an adhesive quality. In some embodiments, the adhesive may be a waterproof formulation that allows artificial lash extensions (and/or detached artificial hairs thereof) to remain affixed to the individual's natural lashes for periods of time (e.g., hours, days, weeks, or months). In some embodiments, the adhesive may be a commercially-available adhesive for conventional lash extensions or a specialized composition for use with the lash extensions described herein. The adhesive may be clear or colored (e.g., milky white or black to emulate mascara).

In some embodiments, the adhesive may be applied using a brush, a comb, or any other type of application tool. In some embodiments, the adhesive may be applied one to two millimeters away from the waterline. In other embodiments, the adhesive may be applied at any location along the natural lashes or along the waterline. In some embodiments, it may be desirable to wait a predetermined period of time prior to proceeding to operation 710 to allow for the adhesive to activate (e.g., partially cure or dry) its adhesive quality.

At operation 710, the user arranges one or more artificial lash extensions at the natural lashes of the user. In some embodiments, the one or more artificial lash extensions may be arranged at the underside of the natural lashes. In some embodiments, the top side of each base of each of the artificial lash extensions can be arranged directly to the underside of the natural lashes (rather than to the eyelid). In some embodiments, the one or more artificial lash extensions may be arranged to align with the curvature of the lash line. For example, multiple artificial lash extensions may be arranged adjacent to one another (e.g., not overlapping or overlapping) such that the bases align with the curvature of the lash line. Thus, the one or more artificial lash extensions may become substantially flush with the lash line when the artificial lash extensions are arranged proximate to the lash line.

In some embodiments, one or more artificial lash extensions can be arranged at the underside of the natural lash at a time. For example, a single artificial lash extension can be arranged first, another artificial lash extension can be arranged subsequently, and so forth. In some embodiments, an applicator, such as electric applicator 400, can be used to arrange the one or more artificial lash extensions. The user can further re-arrange one or more of the artificial lash extensions as desired.

In some embodiments, arranging the one or more artificial lash extensions at the natural lashes of the user includes arranging the one or more artificial lash extensions adjacent to one another at the natural lashes.

In some embodiments, the artificial lash extensions arranged at the natural lashes can include one to eight distinct artificial lash extensions. The number of artificial lash extensions arranged at the natural lashes may be based on the width of the artificial lash extension, the thickness of the artificial hair used, the desired style, the desired lash density (also referred to as "fullness" of the user's lashes), etc.

In some embodiments, rather than applying adhesive to the natural lashes (as discussed at operation 705) and then arranging the one or more artificial lash extensions to the natural lash (as discussed at operation 710), the adhesive may be applied to (e.g., the topside of) one or more artificial lash extensions, and then the artificial lash extensions may be arranged at (e.g., the underside of) the natural lash.

At operation 715, the user can affix the artificial lash extensions to the natural lashes. In some embodiments, each of the artificial lash extensions may be affixed (e.g., bonded) to the underside of the natural lashes. In some embodiments, once the one or more artificial lash extensions are arranged in a desired arrangement, the artificial lash extensions are secured to and more permanently attached (e.g. for days) to a surface, such as the underside of the natural lashes. In some embodiments, one or more of an application of pressure using the electric applicator 400, as described herein, or different applicator or passage of time to cure the adhesive can be used to help affix the detached artificial hairs.

In some embodiments, operations 705 through 715 are performed during a first application session. In some embodiments one or more of operations 720 through 775 are performed during a second application session. In some embodiments, the second application session is performed a time period after the first application session. The time period can be greater than 6 hours or greater than 1 day, for example. In some embodiments, one or more of operations 705 through 775 can be performed during the same application session.

At operation 720, the electric applicator 400 is obtained. In some embodiments, the electric applicator 400 includes a pair of opposing arms and a heating unit. Each arm includes a first section (e.g., section 410) having a first curvature (e.g., curvature 428) disposed between a first end portion (e.g., end portion 424) and a second end portion (e.g., end portion 426) of the first section.

In some embodiments, each arm further includes a first side (e.g., side 412) opposite a second side (e.g., side 414), and an interior surface (e.g., interior surface 418) opposite an exterior surface (e.g., exterior surface 416). The interior surface and the exterior surface extend between the first side and the second side.

In some embodiments, the first section of each arm includes a second curvature (e.g., curvature 434) disposed between the first end portion and the second end portion and along at least a part of the first side corresponding to the first section. In some embodiments, the second curvature is positioned opposite the first curvature. In some embodiments, the first curvature is disposed along at least a part of the second side corresponding to the first section. In some embodiments, first curvature is a concave curvature and the second curvature is a convex curvature.

In some embodiments, at least part of the interior surface corresponding to the first section includes a surface that is substantially flat. In some embodiments, at least part of the interior surfaces corresponding to the first sections of the opposing arms are designed to apply pressure to natural lashes and the artificial lash extensions attached to the natural lashes.

In some embodiments, at least part of the exterior surface corresponding to the first section includes a surface having a third curvature (e.g., curvature 430) extending between the first side and the second side. In some embodiments, at least part of the exterior surface corresponding to the first section is designed to curl one or more of the natural lashes or the artificial lash extensions attached to the natural lashes.

At operation 725, the user activates the heating unit of the electric applicator. Activating the heating unit may heat the first sections of each arm to the desired temperature, in some embodiments.

At operation 730, the heated electric applicator is positioned in an aligned orientation at an eye area of a user. In some embodiments, in the aligned orientation the first curvature of each arm is positioned to align with a lash line of the natural lashes. In some embodiments, the heated electric applicator is positioned in the aligned orientation while in the open position.

At operation 735, the heated electric applicator is transitioned to a closed position. In some embodiments, the heated electric applicator is transitioned to the closed position by closing the first sections of the pair of opposing arms on the natural lashes and artificial lash extensions attached to the natural lashes. In some embodiments, if proceeding to branch A (e.g., curling the natural lashes and/or artificial lash extensions) the first sections of the heated electric applicator can closed on the natural lashes and/or artificial lash extensions near the ends of the natural lashes and/or artificial lash extensions. In some embodiments, if proceeding to branch B (e.g., re-affixing the artificial lash extensions) the first sections of the heated applicator can close on the natural lashes and/or artificial lash extensions near the lash line or base, respectively.

In FIG. 7B at operation 740 of branch A, the heated electric applicator in the closed position is rotated to a rotated orientation. In some embodiments, a user rotates the heated electric applicator in the closed position along a rotational axis to transition the heated electric applicator from the aligned orientation to a rotated orientation. In some embodiments, in the rotated orientation one or more of at least part of the natural lashes or at least part of the artificial lash extensions contact an exterior surface of the first section of at least one of the pair of opposing arms of the heated electric applicator.

At operation 745 of branch A, the heated electric applicator is maintained in the closed position and the rotated orientation for a time period to curl one or more of the natural lashes or the artificial lash extensions.

In FIG. 7C at operation 750 of branch B, the heated electric applicator is maintained in the closed position for a time period. In some embodiments, the heated electric applicator is maintained in the closed position for a time period to soften an adhesive used to attach the artificial lash extensions to the natural lashes.

At operation 755 of branch B, the heated electric applicator is removed from the eye area.

At operation 760 of branch B, the cooling unit of the electric applicator is activated. In some embodiments, activating the cooling unit cools at least the first section of each arm.

At operation 765 of branch B, the cooled electric applicator is positioned at the eye area of the user. In some embodiments, the cooled electric applicator is positioned in the aligned orientation while in the open position.

At operation 770 of branch B, the cooled electric applicator is transitioned to the closed position.

At operation 775 of branch B, the cooled electric applicator is maintained in the closed position for a time period. Maintaining the cooled electric applicator in the closed position can harden the adhesive used to attach the artificial lash extensions to the natural lashes.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Reference throughout this specification to "one embodiment," "certain embodiments," "one or more embodiments," "some embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment," "some embodiments" or "in an embodiment" in various places throughout this specification are not necessarily referring to the same embodiment of the invention. Furthermore, the particular features, structures, materials, or characteristics may be combined in any suitable manner in one or more embodiments.

The terms "connected," "coupled," or any variant thereof includes any connection or coupling between two or more elements, either direct or indirect.

As used herein, the singular forms "a," "an," and "the" include plural references unless the context clearly indicates otherwise. Thus, for example, reference to "an element" includes a single element as well as two or more different elements. The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances.

What is claimed is:

1. An apparatus comprising:

a handle;

a pair of opposing arms coupled to the handle and having interior surfaces facing one another, each arm comprising:

a first section having a first curvature disposed between a first end portion and a second end portion of the first section, the first curvature shaped to align proximate a lash line of an eye, wherein an exterior surface of the first section is curved and the interior surface of the first section is substantially flat, and a second section joined with the first section at a joined part and positioned between the first section and the handle, wherein the first section, the second section and the handle longitudinally extend toward a proximal end, wherein the joined part is closer to the second end portion than the first end portion of the first section, and wherein the opposing arms are configured to move towards one another to transition from an open position to a closed position; and a heating unit coupled to the opposing arms and configured to heat the first section of each arm.

2. The apparatus of claim 1, further comprising:

a cooling unit configured to cool the first section of each arm.

3. The apparatus of claim 1, wherein each arm further comprises:

a first side opposite a second side, and the interior surface opposite an exterior surface, wherein the interior surface and the exterior surface extend between the first side and the second side.

4. The apparatus of claim 3, wherein the first section of each arm comprises a second curvature disposed between the first end portion and the second end portion and along at least a part of the first side corresponding to the first section, and wherein the second curvature is positioned opposite the first curvature.

5. The apparatus of claim 4, wherein the first curvature is disposed along at least a part of the second side corresponding to the first section, and wherein the first curvature is a concave curvature and the second curvature is a convex curvature.

6. The apparatus of claim 3, wherein at least part of the interior surface corresponding to the first section comprises a surface that is substantially flat.

7. The apparatus of claim 6, wherein the at least part of the interior surfaces corresponding to the first sections of the opposing arms are designed to apply pressure to natural lashes and one or more artificial lash extensions arranged at an underside of the natural lashes.

8. The apparatus of claim 3, wherein at least part of the exterior surface corresponding to the first section comprises a curved portion with a surface having a third curvature positioned between the first side and the second side.

9. The apparatus of claim 8, wherein the third curvature of the curved portion of the first section is designed to curl one or more of natural lashes or one or more artificial lash extensions arranged at an underside of the natural lashes.

10. The apparatus of claim 1, wherein the second sections of the opposing arms are configured to be pressed towards one another to transition the first sections from the open position to the closed position.

11. The apparatus of claim 10, wherein at least the exterior surface of the second section comprises a thermally insulating material.

12. The apparatus of claim 1, wherein the heating unit further comprises:

a heating member that extends within the first section of each arm, the heating member to conduct thermal energy to the first section of each arm.

13. The apparatus of claim 12, wherein the heating member comprises resistor wire.

14. The apparatus of claim 2, wherein the cooling unit further comprises:

a cooling member that extends within the first section of each arm.

15. The apparatus of claim 14, where the cooling member of the cooling unit and a heating member of the heating unit are a same member.

16. The apparatus of claim 1, wherein the heating unit comprises a thermoelectric component.

17. The apparatus of claim 2, wherein the heating unit and the cooling unit comprise a same thermoelectric component.

18. The apparatus of claim 1, wherein the exterior surface of the first section comprises a non-stick material.

19. The apparatus of claim 18, wherein the non-stick material comprises silicone.

20. The apparatus of claim 1, wherein the opposing arms are configured to move towards one another to transition from the open position to the closed position responsive to an application of pressure to the opposing arms, wherein in the open position the opposing arms are separated from one another.

21. The apparatus of claim 20, wherein the open position is a default position of the opposing arms.

22. The apparatus of claim 20, wherein in the closed position an interior surface corresponding to the first section of one of the pair of opposing arms is configured to contact an opposing interior surface of another of the pair of opposing arms.

23. The apparatus of claim 10, wherein at least a part of the first section is joined with the second section, and wherein the joined part is closer to the second end portion than the first end portion of the first section.

24. The apparatus of claim 1, wherein the first end portion of the first section of each arm comprises a distal end.

25. The apparatus of claim 24, wherein the distal end of each arm is a single terminal distal end.

26. The apparatus of claim 1, wherein the first curvature of the first section is designed to align substantially flush with a shape of the lash line.

* * * * *